US007182719B2

(12) United States Patent
Tuller

(10) Patent No.: US 7,182,719 B2
(45) Date of Patent: Feb. 27, 2007

(54) ISOMETRIC/PACING EXERCISE DEVICE AND METHOD FOR PERFORMING ISOMETRIC EXERCISES

(76) Inventor: Jeff Tuller, 74848 Saguaro La., Indian Wells, CA (US) 92210

( * ) Notice: Subject to any disclaimer, the term of this patent is extended or adjusted under 35 U.S.C. 154(b) by 0 days.

(21) Appl. No.: 10/989,483

(22) Filed: Nov. 16, 2004

(65) Prior Publication Data

US 2005/0101457 A1 May 12, 2005

Related U.S. Application Data

(62) Division of application No. 10/377,246, filed on Feb. 27, 2003.

(51) Int. Cl.
*A63B 26/00* (2006.01)

(52) U.S. Cl. ..... 482/140; 482/8

(58) Field of Classification Search ..... 482/1–8, 482/148, 91; D21/662, 698; 273/317; 446/491, 446/397

See application file for complete search history.

(56) References Cited

U.S. PATENT DOCUMENTS

| | | | | |
|---|---|---|---|---|
| 3,492,582 | A | 1/1970 | Heywood | 325/66 |
| 5,894,271 | A | 4/1999 | Namisniak | 340/407.2 |
| 5,921,890 | A | 7/1999 | Miley | 482/3 |
| 6,712,742 | B2 | 3/2004 | Suiter | 482/140 |
| 6,719,668 | B1 | 4/2004 | Huang | 482/54 |
| 2003/0134714 | A1* | 7/2003 | Oishi et al. | 482/6 |
| 2003/0171189 | A1* | 9/2003 | Kaufman | 482/8 |
| 2004/0072652 | A1* | 4/2004 | Alessandri et al. | 482/8 |

* cited by examiner

*Primary Examiner*—Lori Amerson
(74) *Attorney, Agent, or Firm*—Patton Boggs LLP

(57) ABSTRACT

An isometric/pacing exercise device that is adaptable to exercise apparatuses to produce a signal to the user to exert an isometric muscular force against the force provided by the exercise apparatus. The signal can be either aural or visual. The isometric/pacing exercise device provides a convenient means for a user to isometrically exercise their muscles on existing exercise apparatuses which do not presently have such a signaling device. The device is adaptable to most exercise apparatuses.

8 Claims, 22 Drawing Sheets

ISOMETRIC/PACING EXERCISE DEVICE AND METHOD FOR PERFORMING ISOMETRIC EXERCISES

RELATED APPLICATIONS

This anplication is a divisional of co-pending application Ser. No. 10/377,246 filed Feb. 27. 2003.

BACKGROUND OF THE INVENTION

1. Field of the Invention

The invention in general relates to physical fitness training, and specifically to exercise devices that provide resistance to movement of a exercise member along an exercise path by a user.

2. Statement of the Problem

Exercise apparatuses that provide resistive movement have been known for over a hundred years. These apparatuses typically include elements that move relative to each other and provide a resistive force to further strengthen and exercise the muscles of a user. Typically, a user exerts muscular force against the resistive force provided by the apparatus to strengthen the user's muscles. These apparatuses exercise a wide variety of muscle groups of a user. Among the various types of muscles groups exercised and strengthened by these apparatuses are: abductor, adductor, lower back, torso, abdominal, bicep, tricep, hip flexors, and leg flexors.

It is known that a beneficial method of exercising and strengthening the muscles of a user involve isometric contractions of the muscles. Isometric contractions are muscle contractions whereby the muscle tension is increased, but the muscle is not shortened because the resistance is not presently overcome. Isometric contraction is also known as static contraction. An isometric contraction also includes holding or pausing during an exercise movement thereby exerting constant force against the resistive force while not shortening or lengthening the muscle. Isometric training is an important part of many fitness routines. Isometric contractions are easily seen in activities such as wrestling, rock climbing and football blocking movements. Isometric exercises are a great way to isolate muscle groups and familiarize a user with how it feels to isolate and exercise a muscle. Hanging from a pull-up bar and performing wall sits are isometric exercises that fitness instructors have been using with athletes for years. Bodybuilding posing routines are a series of isometric contractions. Isometric exercises are also used for rehabilitation of muscle around damaged joints.

Isometric contraction exercises can be performed on almost all exercise apparatuses by pausing during a concentric or eccentric phase of an exercise. Concentric and eccentric phases of an exercise are dynamic movements involving skeletal motion. This is opposed to static or isometric muscle action where muscle contraction takes place without shortening or lengthening the muscle through joint movement. The concentric phase of an exercise is where the muscle shortens as a joint movement occurs under tension. Examples of this phase include the upward portion of a biceps curl (biceps contract), the downward portion of triceps press down (triceps contract), and the upward portion of a squat (quadriceps contract). Another example of the concentric phase is the raising of the weight during a bench press. Further, the upward portion of a barbell row is the concentric portion of the exercise. The eccentric phase of an exercise occurs when the muscle contracts while lengthening under tension in a joint movement. Examples of this phase include the downward portion of a biceps curl (biceps lengthen under tension), the lowering of your body during the downward portion of a pull-up (lats lengthen while under tension), and the downward portion of a squat (quadriceps lengthen under tension). Another example of the eccentric phase is the lowering of the weight during a bench press. Further, the downward portion or a barbell row is the eccentric portion of the exercise. Some of the exercise apparatuses that can provide an isometric exercise are bicep curling machines, lat pull down machines, leg squat machines, etc.

U.S. Pat. No. 5,894,271 issued Apr. 13, 1999 to Namisniak, discloses a wafer-like alert unit which is affixed to a human body surface to provide a silent stimulus such as a vibrational signal to the user at selected time intervals to remind the user to flex adjacent muscle groups or to perform isometric exercise. However, there is no relationship between the signal and the position or status of the exercise apparatus.

Most people rush their exercises, typically doing them in 1–2 seconds per repetition. There have been studies done that show that for adequate muscle activation, repetitions need to be at three to seven seconds, otherwise the momentum of a faster movement reduces the efficiency for the muscle training. Existing exercise apparatuses don't provide a user with an indication or signal to assist the user with modulating or pausing their exercise motion or timing.

Despite the fact that it is known that isometric exercises are beneficial and that most people rush their exercises, there is no method or apparatus known in the prior art that easily permits users to utilize conventional exercise devices for isometric purposes, and no known method or apparatus that assists a user to control their exercise pace. Thus, it is evident that if the advantages inherent in isometric and properly paced exercise are to be enjoyed by the public, a significant advance in such devices is required.

SOLUTION

The present invention advances the art and helps to overcome the aforementioned problems by providing a novel isometric/pacing exercise device that may easily be attached and incorporated into most exercise apparatuses. The isometric/pacing exercise device preferably includes a first element that comes in contact with or in the proximity of, of a second element. Upon contact or proximity of the two elements, an aural or visual signal is produced, signaling the user to pause and isometrically exert force against the force provided by the exercise apparatus.

The present invention also provides a method and apparatus to assist a user in pacing his or her exercise movement when using an exercise device. The pacing device according to the invention preferably includes a first element that signals the user of a predetermined position, so that the user is aware of their cadence along an exercise motion. This enables the user to consistently pace themselves through an exercise and reap the benefits of a paced exercise motion.

The isometric/pacing exercise device according to the invention provides a signal that is adaptable to most exercise apparatuses. In the preferred embodiment, the isometric/pacing exercise device is an aural signal. Further, a user may now modulate or pace their exercise motion, by using the signal produced as a cadence for the exercise. This allows a user to receive the full benefit of adequate muscle activation, due to the user pausing during the signals provided. Each of the above features is separately novel, and the novel combination of all the features results in an isometric/pacing exercise device that should be a welcome addition to a user's exercise equipment stable.

The invention provides an isometric/pacing exercise device for use with an exercise apparatus capable of producing a resistive exercise motion comprising: a first isometric/pacing element attached to or adapted to attach to a first portion of the exercise apparatus; and a second isometric/pacing element; the first isometric/pacing element and the second isometric/pacing element arranged to have relative movement to each other when the exercise device is operated and fashioned to produce a signal when a predetermined distance along the exercise motion is reached. Preferably, the signal is an aural signal. Preferably, the signal is a visual signal. Preferably, the first isometric/pacing element is attached to a first part of the exercise apparatus, and the second isometric/pacing element is attached to a second part of the exercise apparatus. Preferably, the signal is produced as the first element and the second element come in proximity to each other during the use of the exercise apparatus. Preferably, the signal is produced as the first element and the second element come in contact to each other during the use of the exercise apparatus. Preferably, the second isometric/pacing element comprises a tab. Preferably, the signal is an aural signal. Preferably, the one of the first element and the second element comprises a range measuring device. Preferably, the range measuring device comprises a radar device.

In another aspect, the invention provides a compact abdominal exercise apparatus comprising: a lower body member adapted to engage a portion of the human body below the abdomen; an upper body member adapted to engage a portion of the human body above the abdomen; a constraint assembly connecting the lower body member and the upper body member, the constraint assembly permitting relative motion of the lower body member and the upper body member in a first direction along a line connecting the lower body member and upper body member and preventing relative motion of the lower body member and upper body member in directions perpendicular to the first direction, the constraint assembly including a resistance mechanism resisting but not preventing relative motion of the lower body member and the upper body member in the first direction; and an isometric/pacing device adapted to notify the user when a predetermined amount of the relative motion in said first direction occurs. Preferably, the isometric/pacing device comprises a clicker.

The isometric/pacing exercise device according to the invention provides, for the first time, an isometric/pacing exercise device that alerts a user to predetermined exercise positions along an exercise path of an exercise apparatus, so that the user may hold or pause the exercise motion and thereby isometrically exercising the muscles. The isometric/pacing exercise device is easily adaptable to most exercise apparatuses. Numerous other features, objects and advantages of the invention will become apparent from the following description when read in conjunction with the accompanying drawings.

DETAILED DESCRIPTION OF THE PREFERRED EMBODIMENT

Figure 1:
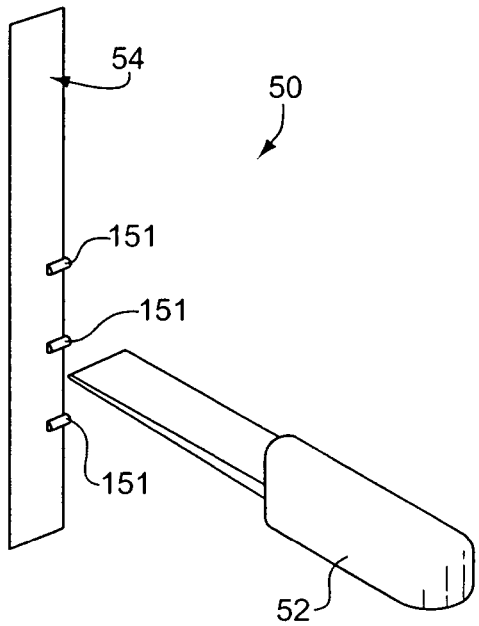
FIG. 1 depicts an embodiment of the isometric/pacing exercise device.
Figure 1A:
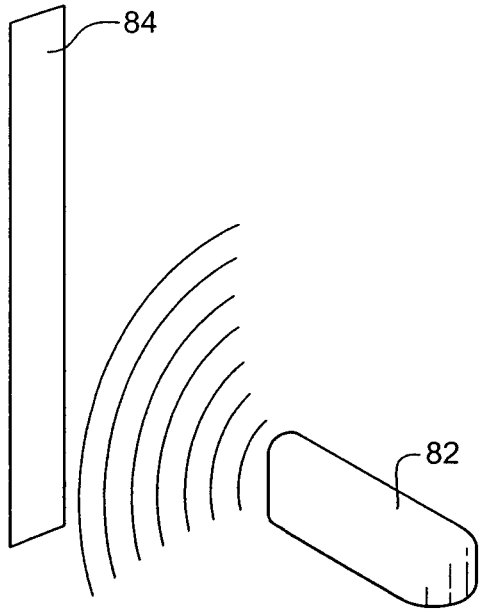
FIG. 1A depicts another embodiment of the isometric/pacing exercise device.

In FIG. 1, the preferred embodiment of the isometric/pacing exercise device 50 is shown. The isometric/pacing exercise device 50 includes a first isometric/pacing element 52 and a second isometric/pacing element 54 that come in contact with each other, or in the proximity of each other, to alert or signal the user to pause and hold the exercise motion and thereby, isometrically exercising the muscle. In this embodiment the second isometric/pacing element 54 includes tabs 151 that produce a sound when they come in contact with the first isometric/pacing element 52. In FIG. 1A, using radar technology, the first isometric/pacing element 82 and second isometric/pacing element 84 can determine the position of an exercise motion on an exercise apparatus and signal the user to pause and hold the exercise motion. The second isometric/pacing element 84 can be a floor, wall, ceiling or other fixed objects relative to the exercise apparatus, such as cross-members and frame members of an exercise apparatus.

In the preferred embodiment, the first isometric/pacing element 52 is a stiff or rigid piece that comes in contact with the second isometric/pacing element 54 to produce a sound to alert or signal the user to pause the exercising motion. In this embodiment, the second isometric/pacing element 54 is a plurality of tabs 151 or ribs that are attached to an exercise apparatus. In another embodiment, the first isometric/pacing element 52 and the second isometric/pacing element 54 produce a visual signal to alert the user to pause the exercising motion. In yet another embodiment, the first isometric/pacing element 82 includes a radar transmit/receive antenna that determines the distance along an exercise path of an exercise apparatus and produces either a visual or aural signal when predetermined positions are reached along the exercise motion or path of an exercise apparatus.

Figure 2:
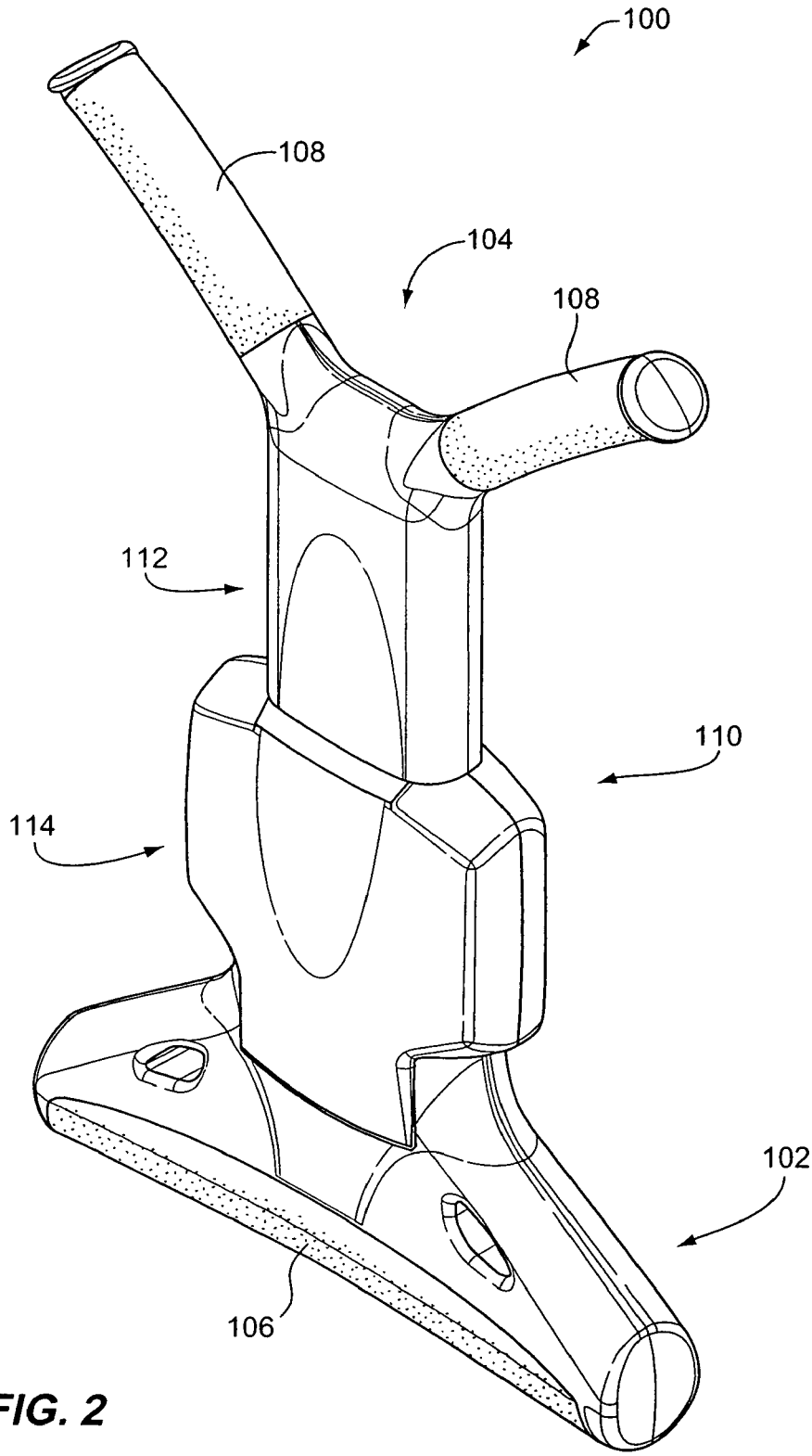
FIG. 2 depicts a perspective view of the preferred embodiment of the isometric/pacing exercise device as incorporated with a compact abdominal exercise apparatus.

In FIG. 2, the isometric/pacing exercise device 50 is shown incorporated into a compact abdominal exercise apparatus 100. The compact abdominal exercise apparatus 100 provides a convenient, comfortable and effective approach to exercising the abdominal muscles of a user. The compact abdominal exercise apparatus 100 includes a lower body support 102 that is placed on top of a user's thighs and an upper body support 104 including handles 108 that are grasped ergonomically by a user's hands. The hands exert downward force on an upper member causing compression of the compact abdominal exercise apparatus 100 and thereby exercising the abdominal muscles.

The rectus abdominus muscles are a pair of long flat muscles, one on either side of the navel, which extend along the whole length of the front of the abdomen from the lower rib cage to the front of the iliac and pubic bones of the pelvis. The rectus abdominus muscles are interconnected by the linea alba, a band of fibrous connective tissue.

The obliquus externus abdominis muscles (external obliques) are broad, thin, flat muscles situated on the lateral and anterior parts of the abdoment and attached by fibrous connective tissue to the abdominus rectus. They extend from the medial margins of the lower rib cage and are directed outwardly toward the rim of the iliac bone of the pelvis.

The obliquus internus abdominis muscles (internal obliques) are thinner and smaller than the obliquus externus muscles. The internal obliques lie beneath the transversely to the external obliques. The internal obliques extend from the lateral margins of the lower rib cage and are directed inwardly toward the rim of the pelvic iliac bone. The internal obliques are also attached to the abdominus rectus muscles by fibrous connective tissue.

FIG. 2 depicts a perspective view of the isometric/pacing exercise device 50 incorporated into a compact abdominal exercise apparatus 100. The compact abdominal exercise apparatus 100 includes a lower body support 102 and an upper body support 104. The lower body support 102 and upper body support 104 slide within each other as depicted in FIGS. 2–6 and 10. The lower body support 102 is connected to a lower body support pad 106. The upper body support 104 includes handles 108 for a user to grasp. The compact abdominal exercise apparatus 100 includes an upper body support 104 and lower body support 102 connector assembly 110.

Figure 3:
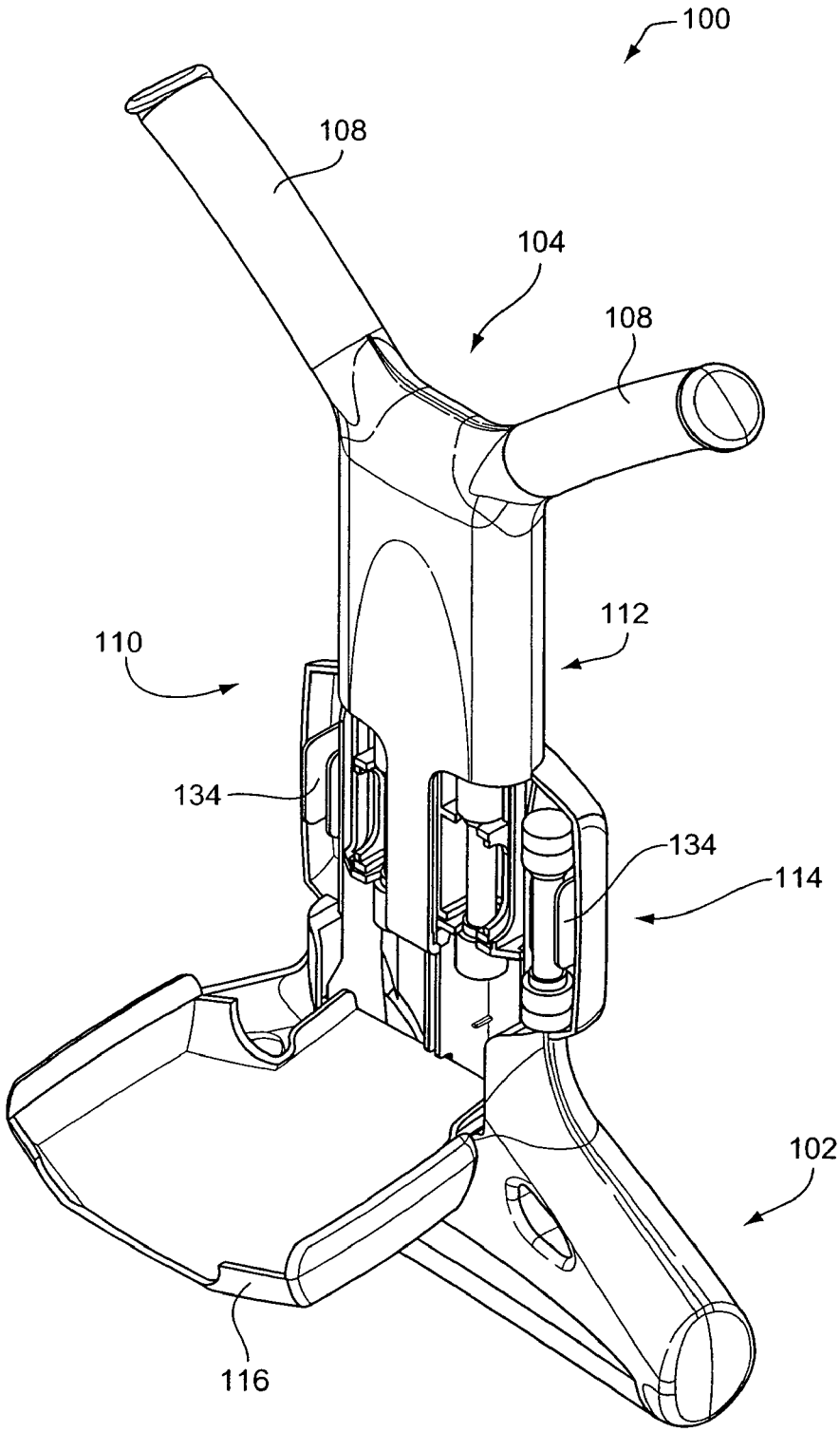
FIG. 3 depicts a perspective view of the preferred embodiment of the isometric/pacing exercise device as incorporated with a compact abdominal exercise apparatus with the protective cover open.
Figure 4:
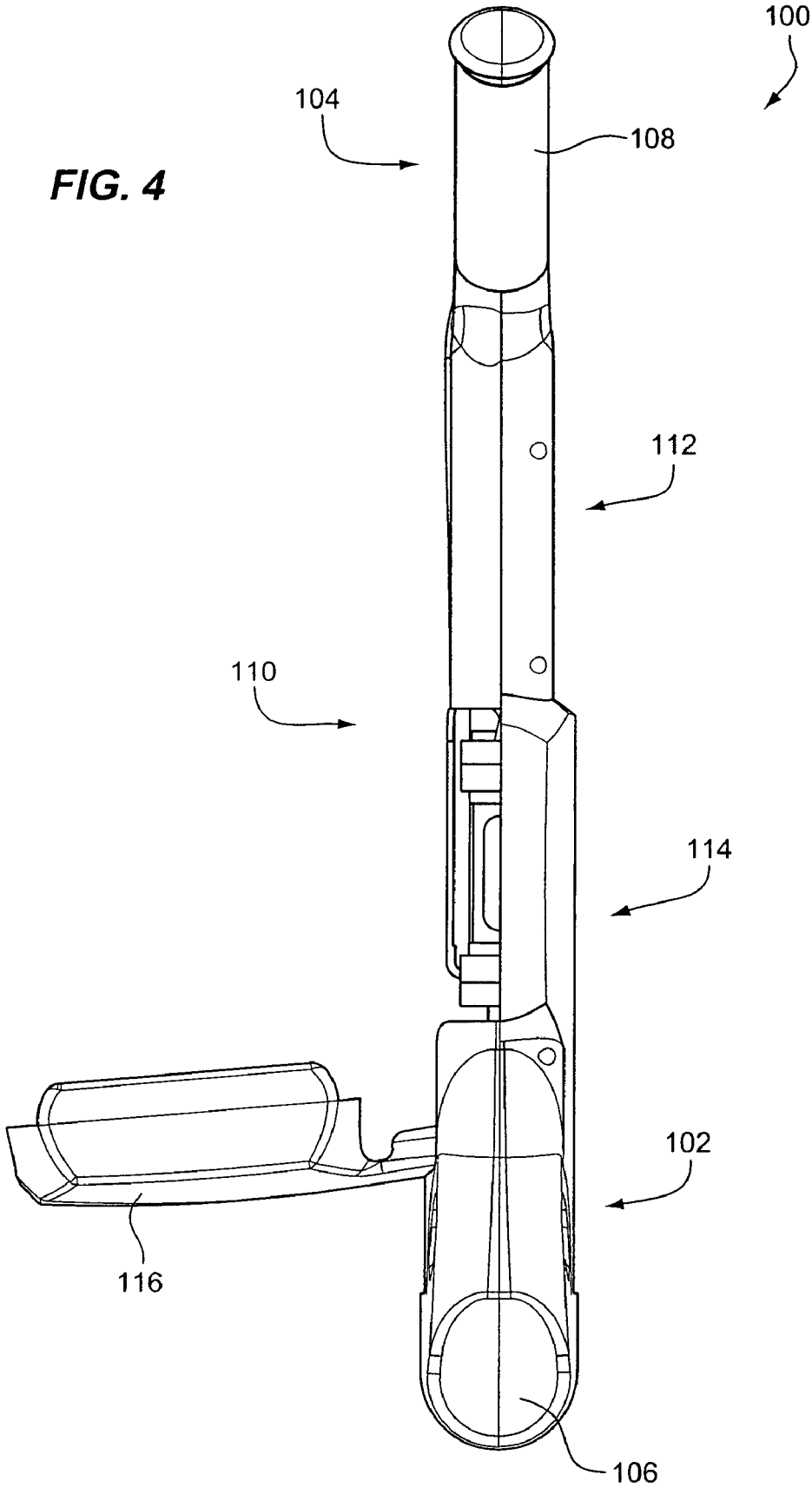
FIG. 4 depicts a side view of the preferred embodiment of the isometric/pacing exercise device as incorporated with a compact abdominal exercise apparatus with the protective cover open.

The connector assembly 110 includes a first member 112 and a second member 114 that interconnect to provide a compact abdominal exercise apparatus 100 that provides crunching abdominal exercises to a user. FIG. 3 depicts a perspective view of the preferred embodiment of the isometric/pacing exercise device 50 incorporated into a compact abdominal exercise apparatus 100 with the protective cover 116 open. The connector assembly 110 is exposed when the protective cover 116 is open. Further, FIGS. 4 and 5 depict a side view and front view of the preferred embodiment of the isometric/pacing exercise device 50 incorporated into a compact abdominal exercise apparatus 100 with the protective cover 116 open.

Figure 5:
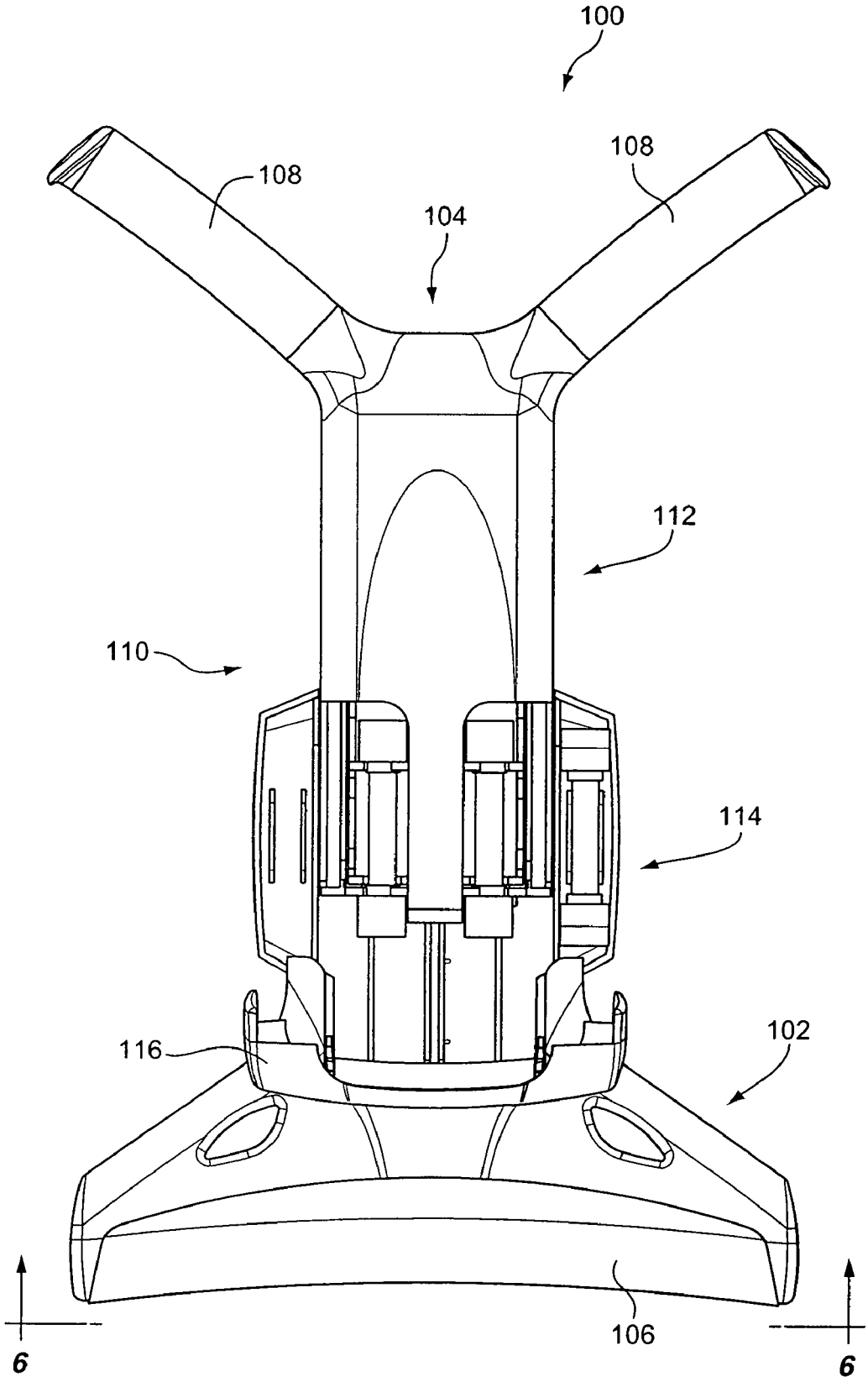
FIG. 5 depicts a front view of an embodiment of the isometric/pacing exercise device as incorporated with a compact abdominal exercise apparatus with the protective cover open.
Figure 6:
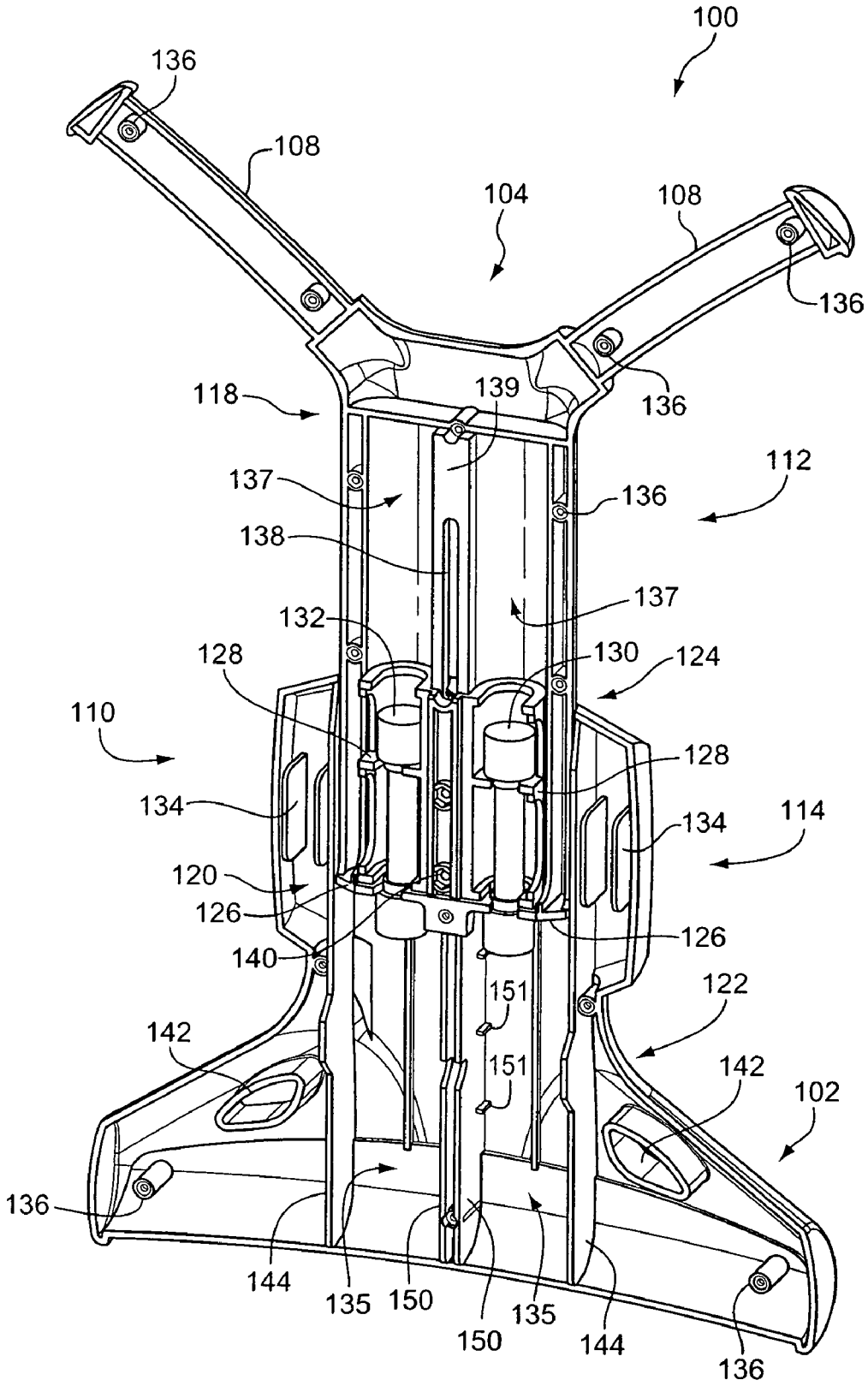
FIG. 6 depicts a cross-section view of the preferred embodiment of the isometric/pacing exercise device as incorporated with a compact abdominal exercise apparatus.

FIG. 6 depicts a cross-section view through the lines 6—6 of FIG. 5 of the isometric/pacing exercise device 50 incorporated into a compact abdominal exercise apparatus 100. The first member 112 includes a first member proximal end 118 and a first member distal end 120. The second member 114 also includes a second member proximal end 122 and a second member distal end 124. The first member 112 also includes a first elastic anchor member 126 that is connected to the first member 112 in the proximity of the first member distal end 120. The second member 114 also includes a second elastic anchor member 128 connected to the second member 114 in the proximity of the second member distal end 124. The first elastic anchor member 126 and the second elastic anchor member 128 are connected together by a first elastic member 130. Preferably, a second elastic member 132 is employed to add increased resistance during operation of the compact abdominal exercise apparatus. Preferably, additional elastic members are stored in optional spare elastic member ribs 134 located adjacent to the location of second elastic anchor member 128 or elsewhere, where space exists to store additional elastic members.

Figure 10:
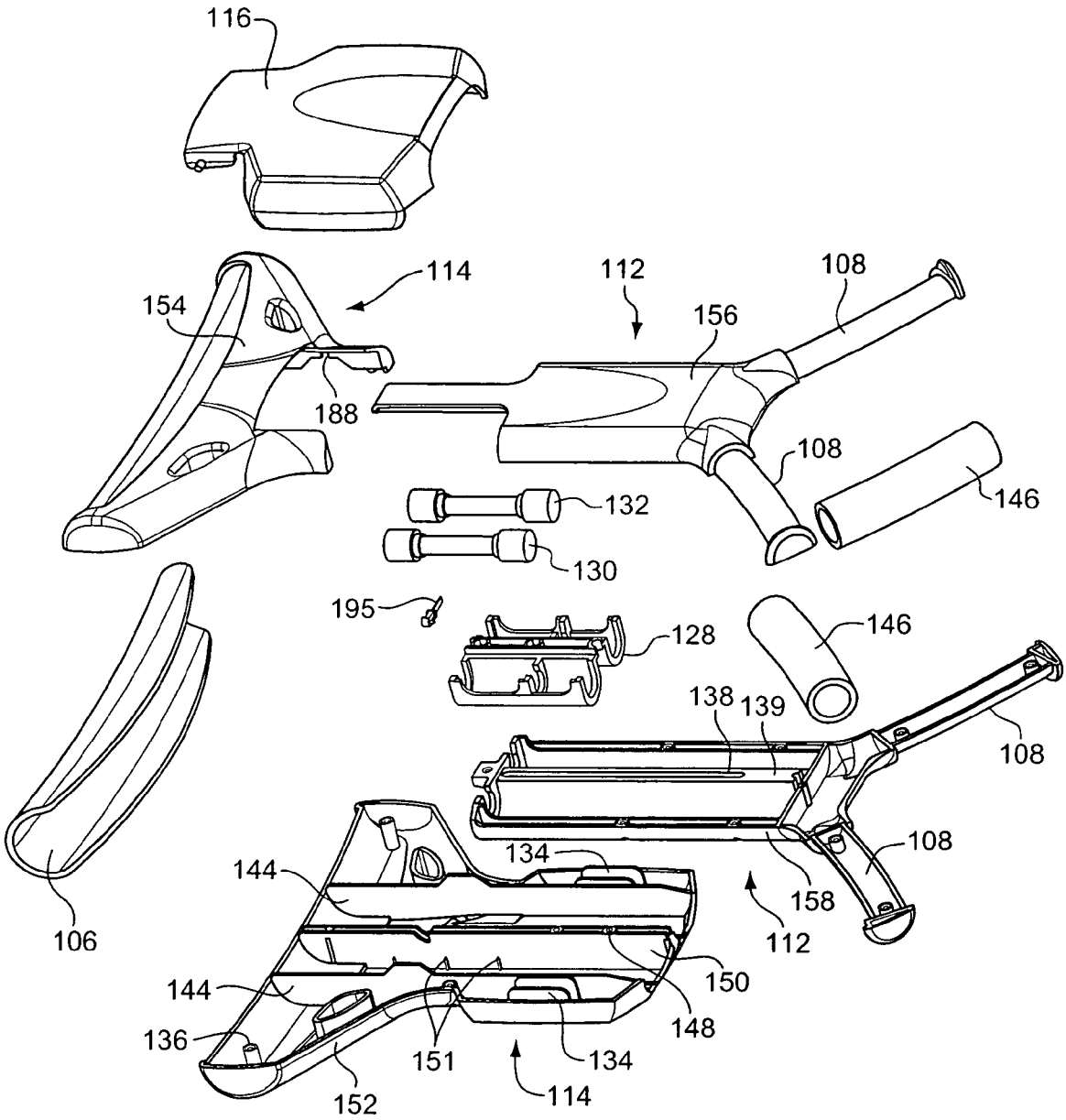
FIG. 10 depicts an exploded view of the preferred embodiment of the isometric/pacing exercise device as incorporated in a compact abdominal exercise apparatus.

When the first member 112 or second member 114 are molded into two or more pieces as shown in FIGS. 3–6, the pieces can be held together by fasteners, such as screws that screw into screw bosses 136, located in various locations on the first member 112 and the second member 114. In the preferred embodiment of the present invention, the first member 112 includes first member channels 137 that are formed to fit the second elastic anchor member 128. The slot 138 allows fasteners, such as the second anchor member fasteners 140, to fasten the second elastic anchor member 128 to the second member 114 while allowing the first member 112 to slideably move between the second elastic anchor member 128 and the second member 114. The slot 138 allows the first member 112 to slideably move relative to the second member 114, when the second elastic anchor member 128 is attached to the second member 114. The first member 112 also includes a first member ridge 139 that is formed to fit between the second elastic anchor member 128 and the second member 114. The second elastic member 132 is attached to the second member 114 by elastic anchor member fasteners 140. Vent holes 142 equilibrate the air pressure within the compact abdominal exercise apparatus 100 during use by a user. The second member 114 includes second member outer channels 144 that guide the first member 112 to slideably move relative to the second member 114. The second member 114 also includes second member inner channels 150 that guide the first member 112 to slideably move relative to the second member 114. The second member channels 135 are defined by the area between the second member outer channels 144 and the second member inner channels 150. Preferably, the second member 114 is molded into one, two or more pieces. In FIG. 10, a two piece second member 114 is shown. Preferably, second member 114 includes second isometric/pacing element 54 that provide a resistance for the first isometric/pacing element 195, described in detail below. Preferably, second isometric/pacing element 54 are one, two or more tabs 151 and preferably are located on either side of the second member inner channels 150. The second isometric/pacing element 54 are tabs 151, or other elements that create a signal when they come in contact or in proximity with the first isometric/pacing element 195.

Figure 7:
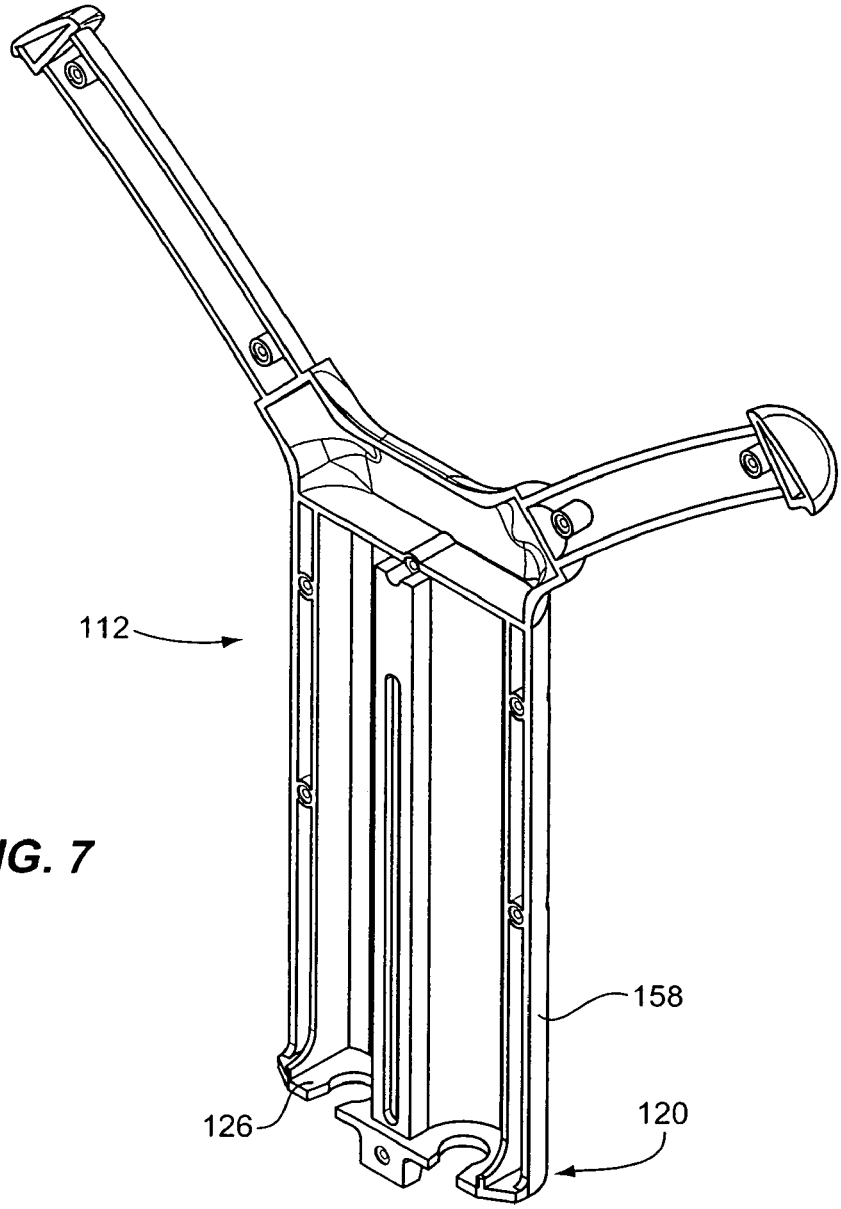
FIG. 7 depicts a perspective view of the isometric/pacing exercise device as incorporated with the back first member of a compact abdominal exercise apparatus.
Figure 8:
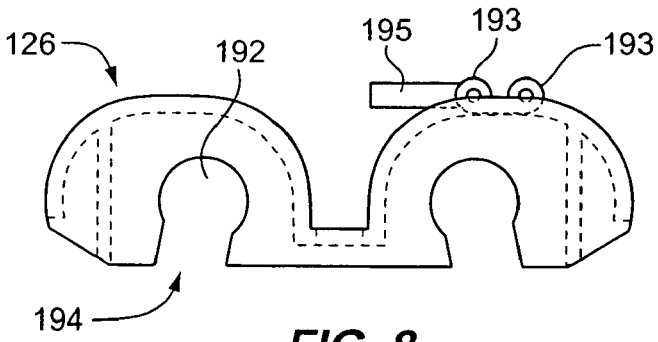
FIG. 8 depicts an end view of the isometric/pacing exercise device as incorporated with a first elastic anchor member of a compact abdominal exercise apparatus.

FIG. 7 depicts a perspective view of the back first member 158 of the preferred embodiment of the isometric/pacing exercise device 50 incorporated into a compact abdominal exercise apparatus 100. Near the proximity of the first member distal end 120 is the first elastic anchor member 126 which holds one end of the elastic members 130, 132, and 160. FIG. 8 depicts an end view of the first elastic anchor member 126 of the preferred embodiment of the isometric/pacing exercise device 50 incorporated into a compact abdominal exercise apparatus 100. The first elastic anchor member 126 includes a first elastic anchor member hole 192 and a first elastic anchor member opening 194. The first elastic anchor member opening 194 is sized slightly smaller than the first elastic anchor member hole 192 to allow the elastic member body 190 to fit through but not the elastic member end, thereby creating a catch for the elastic members 130, 132, and 160. Preferably, the first elastic anchor member 126 includes first isometric/pacing member screw bosses 193 to fasten the first isometric/pacing element 195 to the first elastic anchor member 126. First isometric/pacing element 195 is described in more detail below.

Figure 9A:
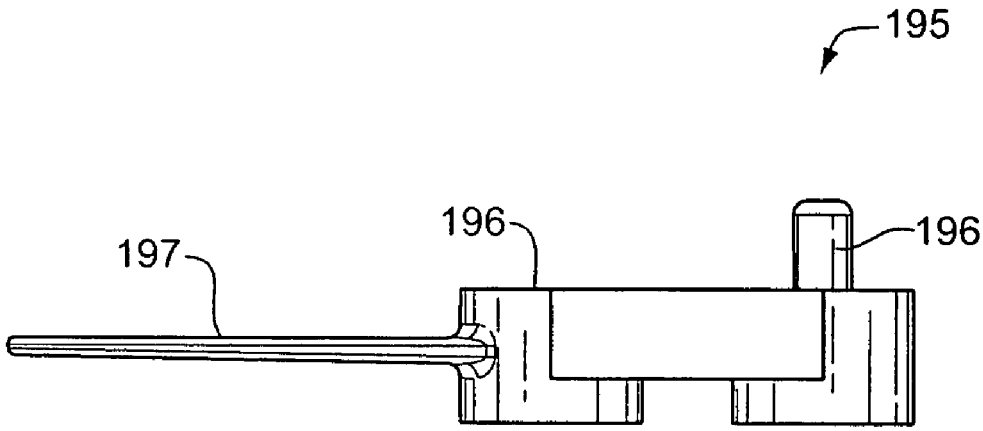
FIG. 9A depicts a side view of the preferred embodiment of the isometric/pacing exercise device.
Figure 9B:
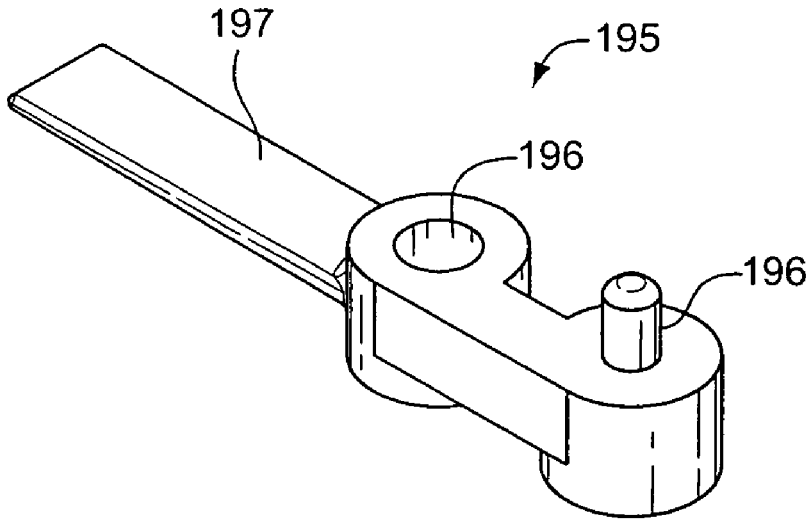
FIG. 9B depicts a perspective view of the preferred embodiment of the isometric/pacing exercise device.

FIG. 9A depicts a side view of the preferred embodiment of the first isometric/pacing element 195. The first isometric/pacing element 195 includes first isometric/pacing element fasteners 196 that fasten into first isometric/pacing element screw bosses 193. Preferably, first isometric/pacing element fasteners 196 protrude or include recessed holes for a screw. First isometric/pacing element 195 also includes a first isometric/pacing member tab 197 that contacts the second isometric/pacing element 54 as the first member 112 is forced by the user downward toward the second member 114. FIG. 9B depicts a perspective view of the preferred embodiment of the first isometric/pacing element 195.

FIG. 10 depicts an exploded view of the preferred embodiment of the isometric/pacing exercise device 50 incorporated into a compact abdominal exercise apparatus 100. Preferably, the handles 108 are covered with optional handle covers 146. The second member 114 includes second elastic anchor member mounts 148 for accepting the second elastic anchor member fasteners 140. The second member 114 also includes second member inner channels 150 that guide the first member 112 to slideably move relative to the second member 114. Preferably, the second member 114 is molded into one, two or more pieces. In FIG. 10, a two piece second member 114 is shown. Preferably, second member 114 includes a tab 151 that provides a resistance for the first isometric element 195, described in detail below. Preferably, tab 151 are one, two or more tabs and preferably are located on either side of the second member inner channels 150. Second member 114 includes a back second member 152 and a front second member 154. Preferably, the first member 112 is molded into one, two or more pieces. In FIG. 10, a two piece first member 112 is shown. First member 112 includes a front first member 156 and a back second member 158.

Figure 11:
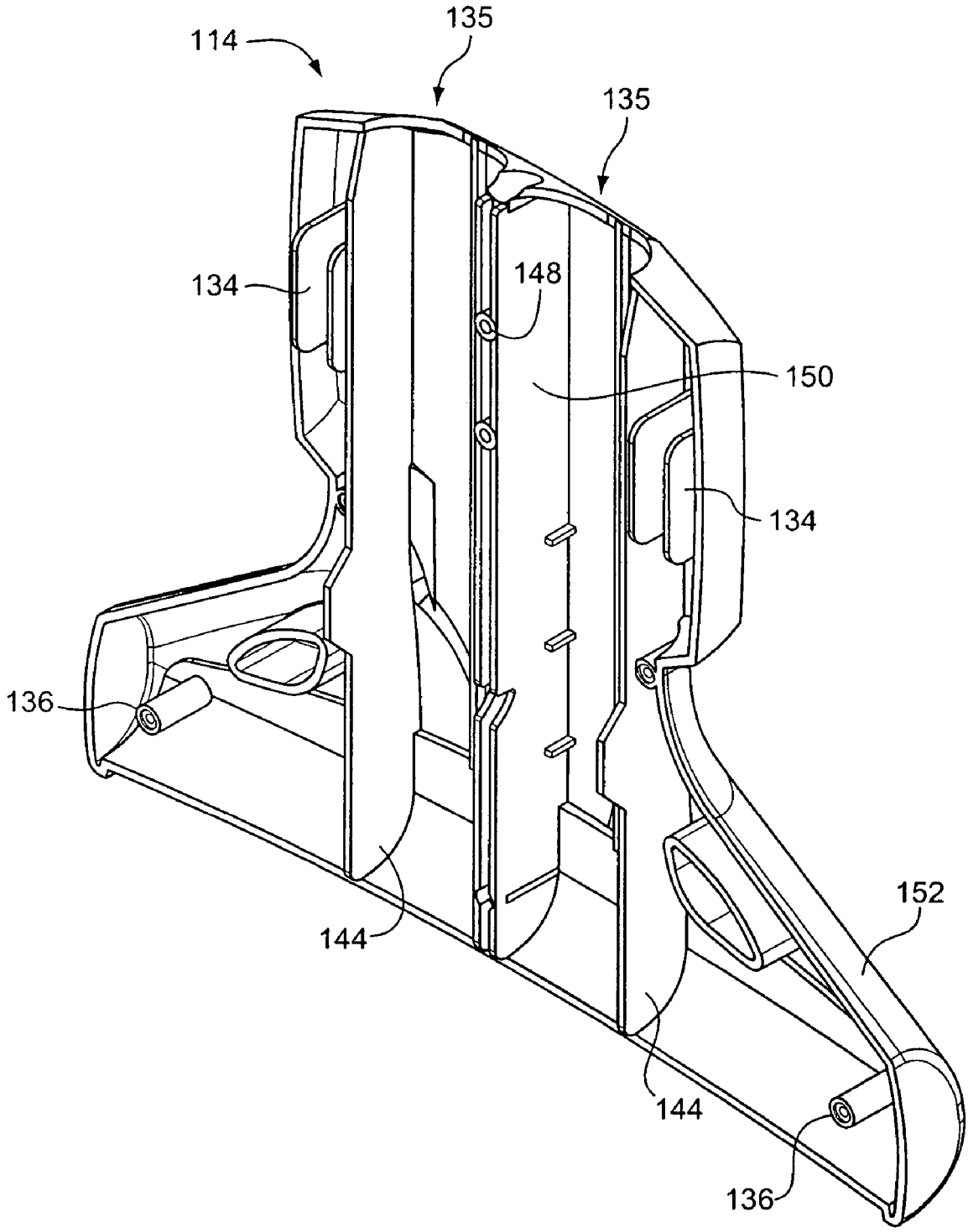
FIG. 11 depicts a perspective view of the preferred embodiment of the isometric/pacing exercise device tabs as incorporated with a back second member in a compact abdominal exercise apparatus.
Figure 12:
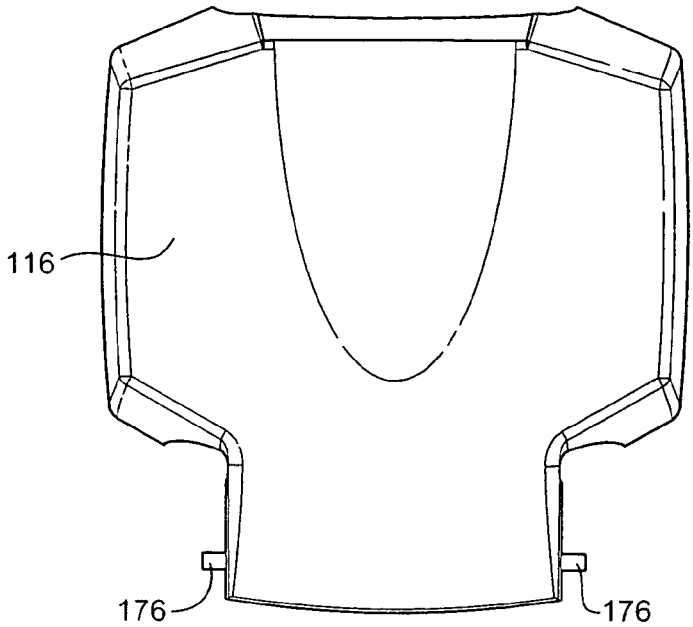
FIG. 12 depicts a front view of an aspect of the protective cover.
Figure 13:
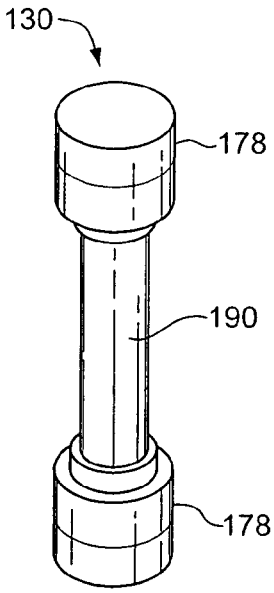
FIG. 13 depicts a perspective view of an aspect of an elastic member.

FIG. 11 depicts a perspective view of the preferred embodiment of the back second member 152. The back second member 152 includes second member channels 135 defined by the second member outer channels 144 and the second member inner channels 150. FIG. 12 depicts a front view of an embodiment of the protective cover 116. In the preferred embodiment of the present invention, the protective cover 116 attaches to the front second member 154 of the second member 114. The protective cover 116 includes protective cover hinge tabs 176 that fit into front second member holes 188, as depicted in FIG. 12, in the second member 114. FIG. 13 depicts a perspective view of an embodiment of the elastic members 130 and 132. Preferably, the first elastic member 130 and second elastic member 132 include a slightly larger end such as elastic member end 178 that preferably is larger in size than the elastic member body 190 and than the second elastic anchor member opening 180, as depicted in FIG. 14.

Figure 14:
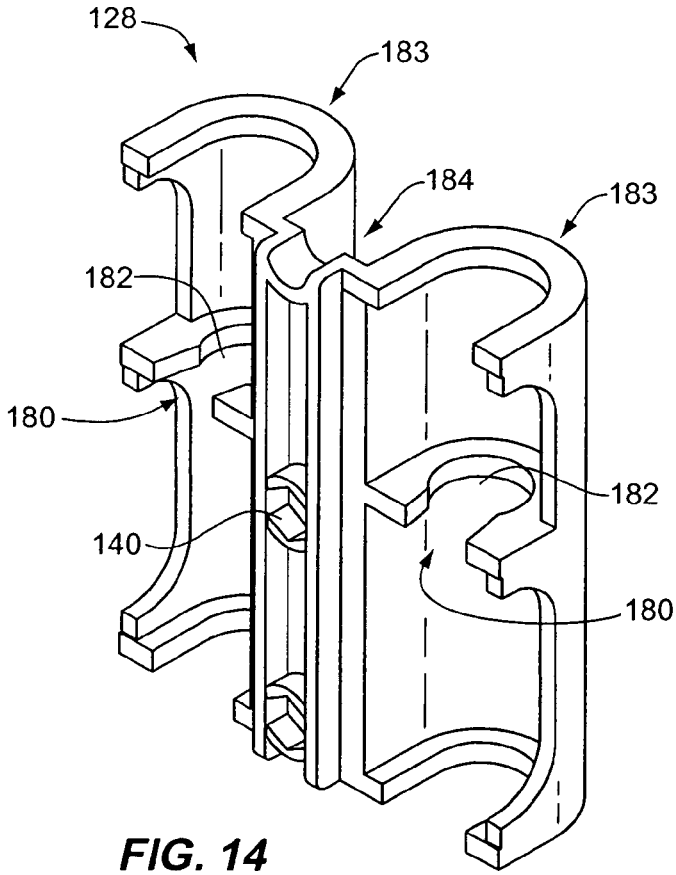
FIG. 14 depicts a perspective view of an aspect of a second elastic anchor member.

FIG. 14 depicts a perspective view of an embodiment of a second elastic anchor member 128. In an embodiment of the present invention, the second elastic anchor member 128 includes an indent or recessed area, such as the second elastic anchor member indent 184. In this embodiment, the second elastic anchor member indent 184 of the second elastic anchor member 128 is formed to fit next to the first member ridge 139. The second elastic anchor member 128 also includes a curved area that fits within the first member channels 137, such as the second elastic anchor member curved portion 183. The second elastic anchor member 128 also includes a second elastic anchor member opening 180. The second elastic anchor member opening 180 is sized so to allow the elastic member body 190 to fit within the opening. The second elastic anchor member 128 also includes a second elastic anchor member upper catch 182 that is sized so to allow the elastic member body 190 to fit within the opening, but the opening is a smaller size than the elastic member end 178 of the elastic members 130 and 132 so as to be a catch and hold the elastic members 130 and 132 in position as the compact abdominal exercise apparatus 100 is used.

Figure 15:
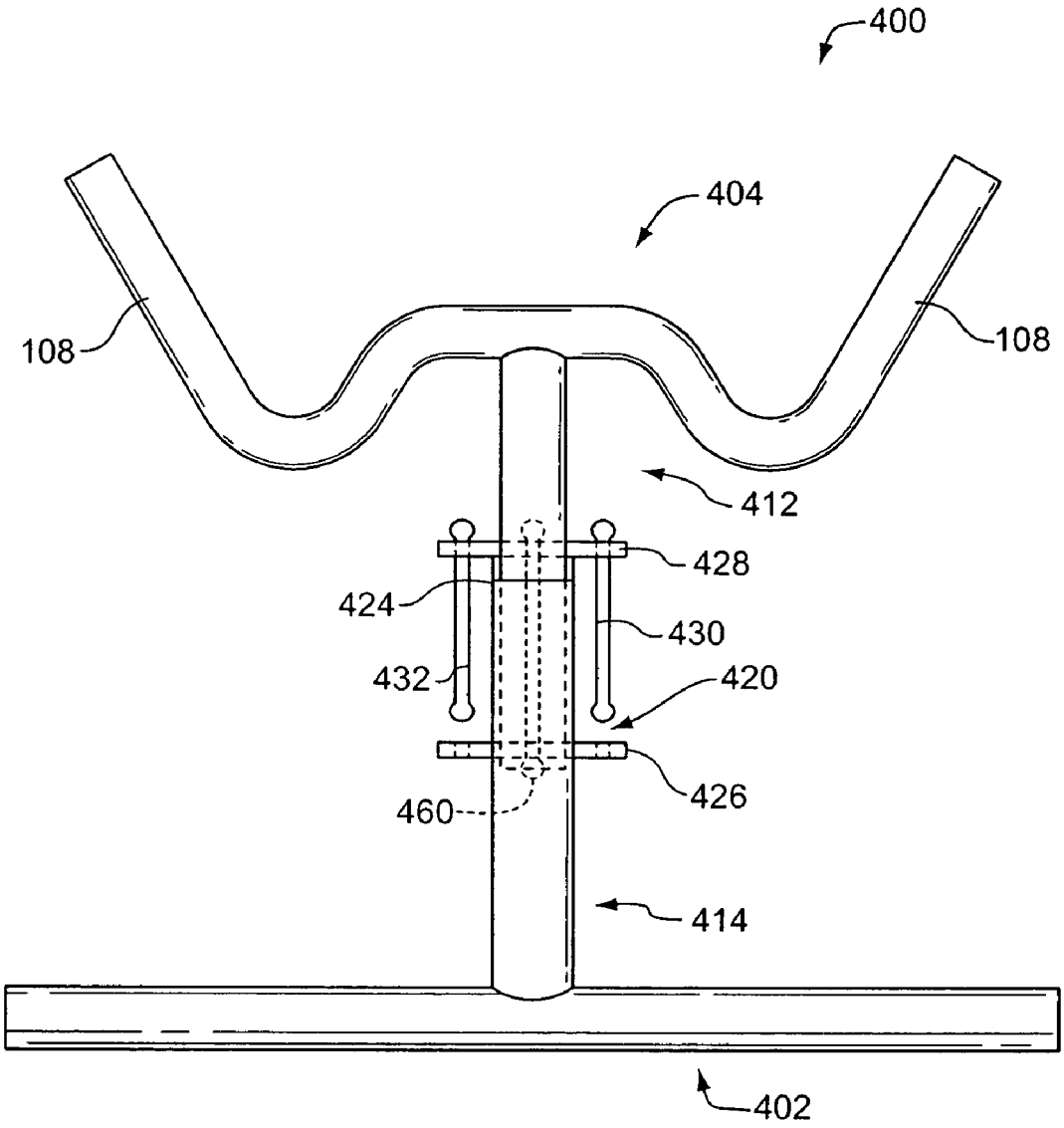
FIG. 15 depicts a front view of another embodiment of the compact abdominal exercise apparatus.

FIG. 15 depicts a front view of another embodiment 400 of the isometric/pacing exercise device 50 incorporated into a compact abdominal exercise apparatus. In this embodiment, the compact abdominal exercise apparatus 400 includes an upper body support 404 connected to the first member 412 and a lower body support 402 connected to the second member 414. The compact abdominal exercise apparatus 400 includes a lower body support 402 that is placed on top of a user's thighs and an upper body support 404 including handles 408 that are grasped ergonomically by a user's hands. In this embodiment, the first member 412 and the second member 414 are of a tubular configuration. Preferably, the tubular configuration is cylindrical or a pipe or cylinder that has a cross-section of a square, rectangle, pentagon, hexagon or other geometric shapes. The second elastic anchor member 428 is attached in the proximity of the second member distal end 424. The first elastic anchor member 426 is attached to the proximity of the first member distal end 420. FIG. 15 depicts an optional third elastic member 460 connected between the second elastic anchor member 428 and the first elastic anchor member 426. The second elastic member 432 and the first elastic member 430 are depicted connected to the second elastic anchor member 428 but not the first elastic anchor member 426. In this embodiment, the size or diameter of the first member 412 is slightly less than the size or diameter of the second member 414, to enable the first member 412 to slideably move within the second member 414.

The first member proximal end 418 is the same end that the handles 408 are attached to the first member 412. The first member distal end 420 is the opposite end from the first member proximal end 418 of the first member 412. The second member proximal end 422 is the same end that the lower body support 402 is attached to the second member 414. The second member distal end 424 is the opposite end from the second member proximal end 422 of the second member 414.

Preferably, elastic members 430, 432, and 460 are made of rubber or some other elastic material. Preferably, the elastic members 430, 432, and 460 have ends that are of a larger size or diameter than the second elastic anchor member 428 and the first elastic anchor member 426 openings. Preferably, the elastic members 430, 432, and 460 are elastic bands or elastic rubber bands.

Figure 16:
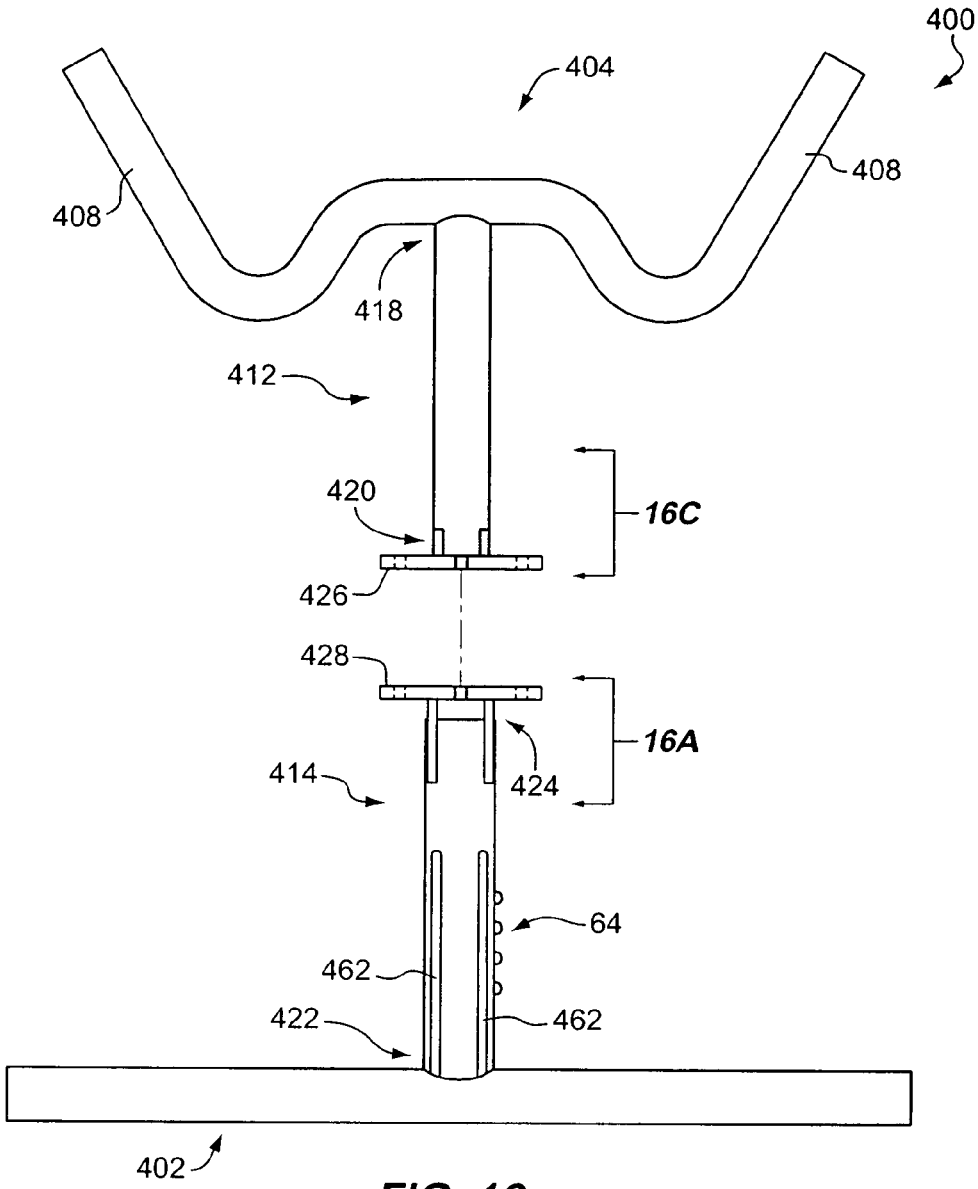
FIG. 16 depicts an exploded view of the embodiment depicted in FIG. 15 of the compact abdominal exercise apparatus.
Figure 16A:
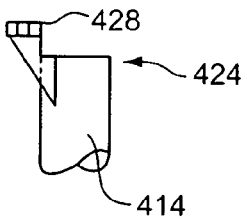
FIG. 16A depicts a side view of the second elastic anchor member as depicted in the embodiment in FIG. 15 of the compact abdominal exercise apparatus.
Figure 16B:
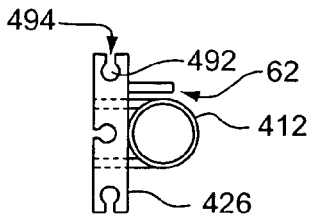
FIG. 16B depicts a top view of an embodiment of the isometric/pacing exercise device as incorporated in the first elastic anchor member as depicted in the embodiment in FIG. 15 of the compact abdominal exercise apparatus.
Figure 16C:
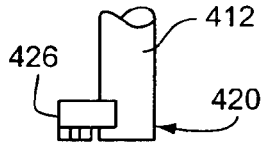
FIG. 16C depicts a side view of the first elastic anchor member as depicted in the embodiment in FIG. 15 of the compact abdominal exercise apparatus.

FIG. 16 depicts an exploded view of the embodiment depicted in FIG. 15 of the isometric/pacing exercise device 50 incorporated into a compact abdominal exercise apparatus 400. The first member 412 and second member 414 are separated to depict second member slots 462. Preferably, there are one, two, or more second member slots 462 and in FIG. 16, two are shown. The first elastic anchor member 426 protrudes through these second member slots 462 when the first member 412 and second member 414 are slid together as shown in FIG. 15. FIGS. 16A–16C, depict various views of the first elastic anchor member 426 and the second elastic anchor member 428.

FIG. 16A depicts a portion of the second member distal end 424 of the second member 414 and the second elastic anchor member 428 that is attached to the second member distal end 424. In FIG. 16B, the first member 412 is shown from a distal end view. The first elastic anchor member 426 is shown attached to the first member distal end 420 of the first elastic anchor member 426. The first elastic anchor member holes 492 of the first elastic anchor member 426 are shown with a narrower opening than the first elastic anchor member hole 492 diameter, to facilitate the holding of the first elastic member 430, second elastic member 432 and third elastic member 460. As in the embodiment described above, these elastic members 430, 432, and 460 preferably have an elastic member end 478 that is a greater diameter than the elastic member body 490, thereby enabling a user to easily connect and disconnect the elastic members 430, 432 and 460 from the first elastic anchor member 426 and second elastic anchor member 428. Though FIG. 16B depicts the first elastic anchor member 426, the size of first elastic anchor member holes 492 and dimension of the first elastic anchor member 426, the second elastic anchor member 428 preferably possesses these same first elastic anchor member hole 492 sizes and dimensions. A first isometric/pacing element 62 is shown adapted to the first elastic anchor member 426. The first isometric/pacing element 62 comes in contact with the second isometric/pacing element 64, as shown in FIG. 16, to produce a signal. FIG. 16C depicts a portion of the first member distal end 420 of the first member 412 and the first elastic anchor member 426 that is attached to the first member distal end 420.

Figure 17:
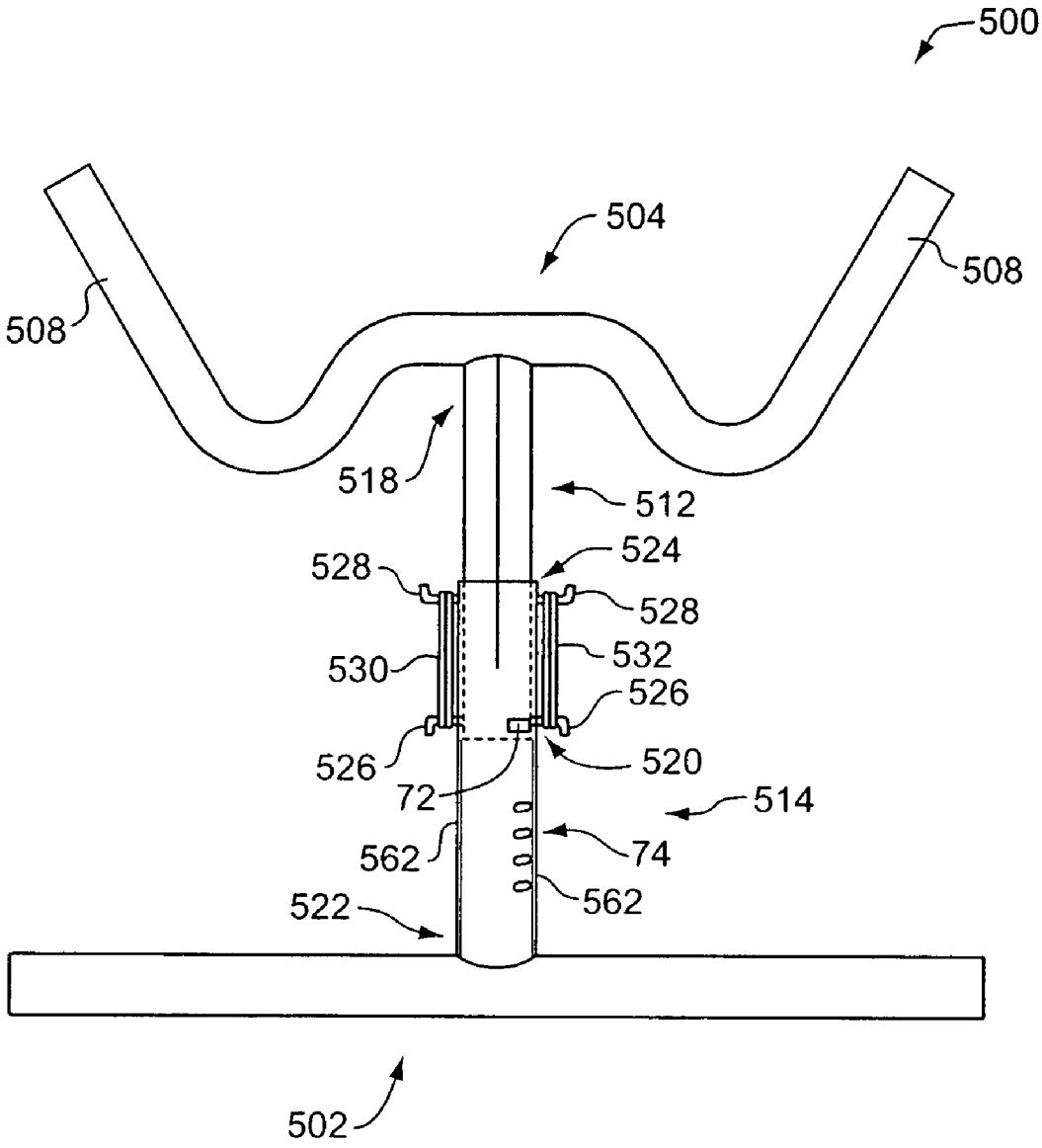
FIG. 17 depicts a front view of another embodiment of the compact abdominal exercise apparatus.

FIG. 17 depicts a front view of another embodiment 500 of the isometric/pacing exercise device 50 incorporated into a compact abdominal exercise apparatus. In this embodiment, the compact abdominal exercise apparatus 500 includes an upper body support 504 connected to the first member 512 and a lower body support 502 connected to the second member 514. The compact abdominal exercise apparatus 500 includes a lower body support 502 that is placed on top of a user's thighs and an upper body support 504 including handles 508 that are grasped ergonomically by a user's hands.

The first member proximal end 518 is the same end that the handles 508 are attached to the first member 512. The first member distal end 520 is the opposite end from the first member proximal end 518 of the first member 512. The second member proximal end 522 is the same end that the lower body support 502 is attached to the second member 514. The second member distal end 524 is the opposite end from the second member proximal end 522 of the second member 514.

In this embodiment, the first member 512 and the second member 514 are of a tubular configuration. The tubular configuration preferably is cylindrical or pipe or cylinder that has a cross-section of a square, rectangle, pentagon, hexagon or other geometric shapes. The second elastic anchor member 528 is attached in the proximity of the second member distal end 524. The first elastic anchor member 526 is attached to the proximity of the first member distal end 520. In this embodiment the size or diameter of the first member 512 is slightly less than the size or diameter of the second member 514, to enable the first member 512 to slideably move within the second member 514.

Preferably, elastic members 530, 532, and 560 are made of rubber or some other elastic material. Preferably, the elastic members 530, 532, and 560 have ends or are shaped to allow the second elastic anchor member 528 and the first elastic anchor member 526 to hold the elastic members 530, 532, and 560. Preferably, the elastic members 530, 532, and 560 are elastic bands or elastic rubber bands.

The second member 514 includes second member slots 562. Preferably, there are one, two or more second member slots 562 and in FIG. 17, two are shown. The first elastic anchor member 526 protrudes through these second member slots 562 when the first member 512 and second member 514 are slid together as shown in FIG. 17.

In this embodiment, the first elastic anchor member 526 and second elastic anchor member 528 are configured to hold a first elastic member 530 and a second elastic member 532 that are elastic bands, like heavy-duty rubber bands designed for exercise apparatuses. In FIG. 17, the first elastic anchor member 526 and second elastic anchor member 528 are shown being capable of connecting two elastic members. The first elastic anchor member 526 and second elastic anchor member 528 could be such that they support one, two or more elastic members. In this embodiment, a first isometric/pacing element 72 is adapted to the first elastic anchor member 526 and the second isometric/pacing element 74 is adapted to the second member 514.

Figure 18:
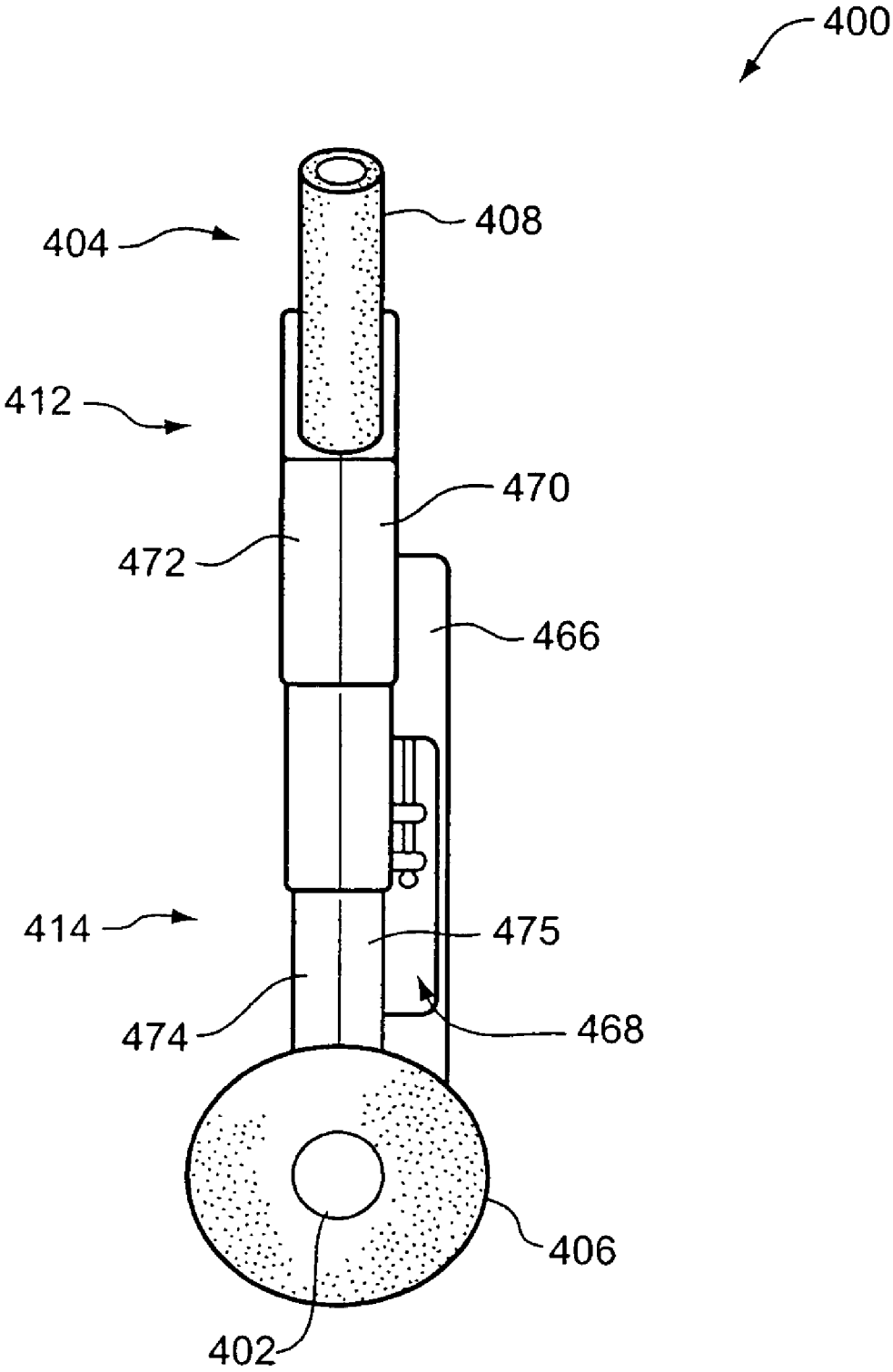
FIG. 18 depicts a side view of the embodiment depicted in FIGS. 15–17 of the compact abdominal exercise apparatus with molded covers covering the internal mechanical features.
Figure 19:
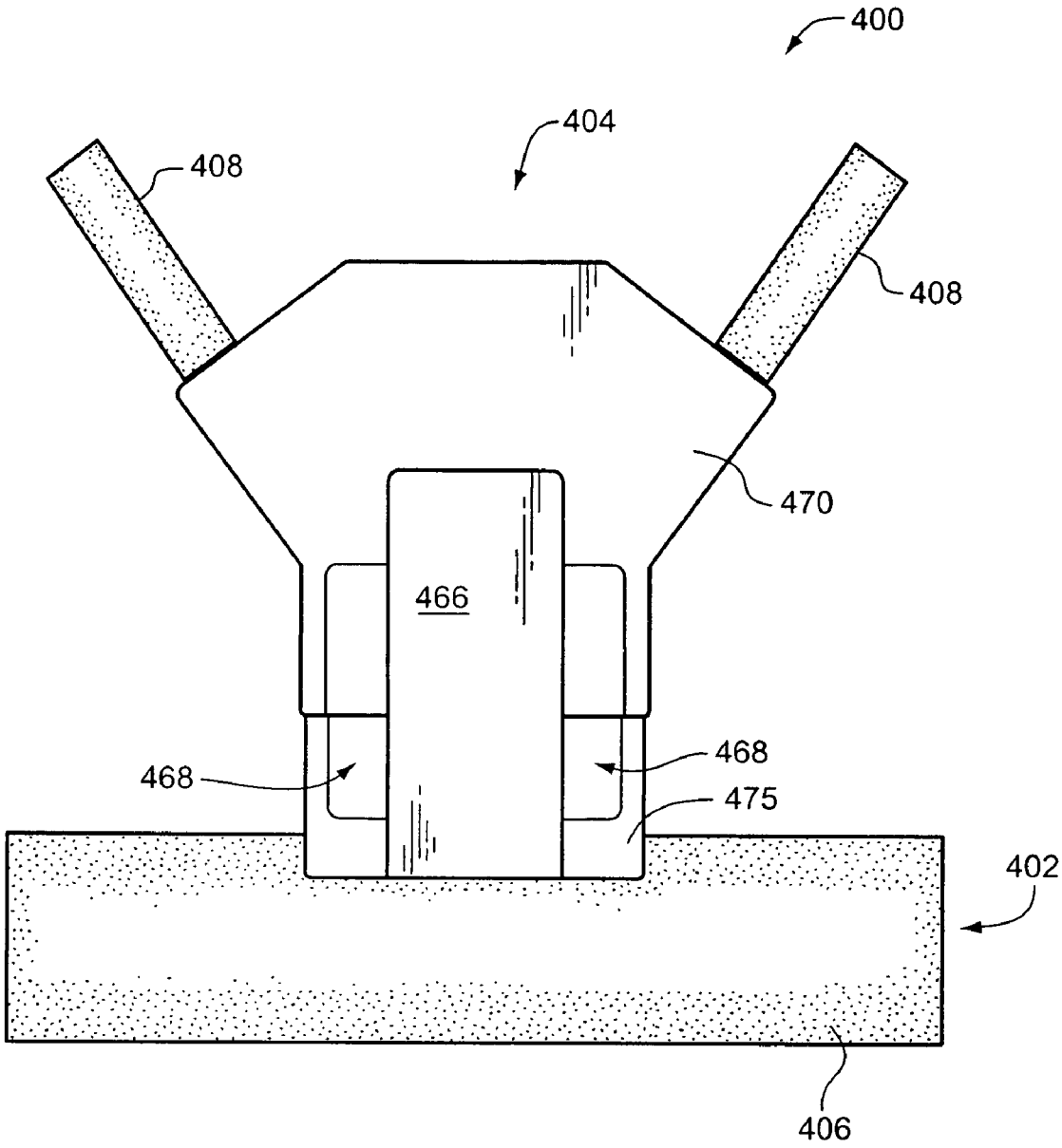
FIG. 19 depicts a rear view of the embodiment depicted in FIGS. 15–17 of the compact abdominal exercise apparatus 100.

FIG. 18 depicts a side view of the embodiments depicted in FIGS. 15–17 of the compact abdominal exercise apparatus 400 and 500 with molded covers covering the internal mechanical features. The compact abdominal exercise apparatus 400 includes an upper front protective cover 472 and an upper rear protective cover 470 that cover the some of internal mechanical features, as depicted in FIGS. 15–17. The compact abdominal exercise apparatus 400 also includes lower front protective cover 474 and a lower back protective cover 475 that covers some of the internal mechanical features. A slotted protective access cover 466 has a quick access opening 468 to allow access to the elastic members 430, 432, 460, 530, 532, and 560. FIG. 19 depicts a rear view of the embodiments depicted in FIGS. 15–18 of the compact abdominal exercise apparatus 400 and 500.

Figure 20B:
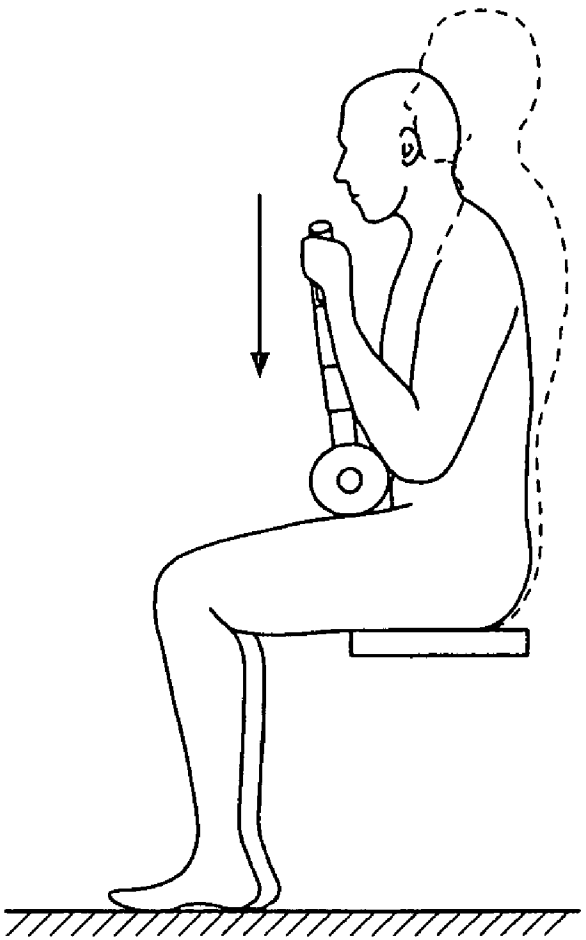
FIGS. 20A–20B depict is a side view demonstrating a user in a sitting position exercising with the isometric/pacing exercise device as incorporated with a compact abdominal exercise apparatus.
Figure 20A:
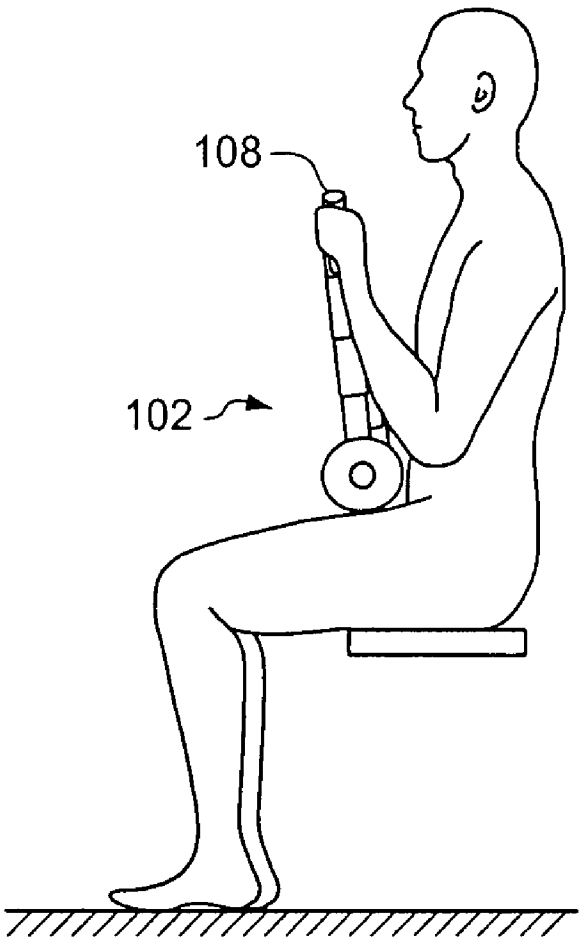
Figure 21:
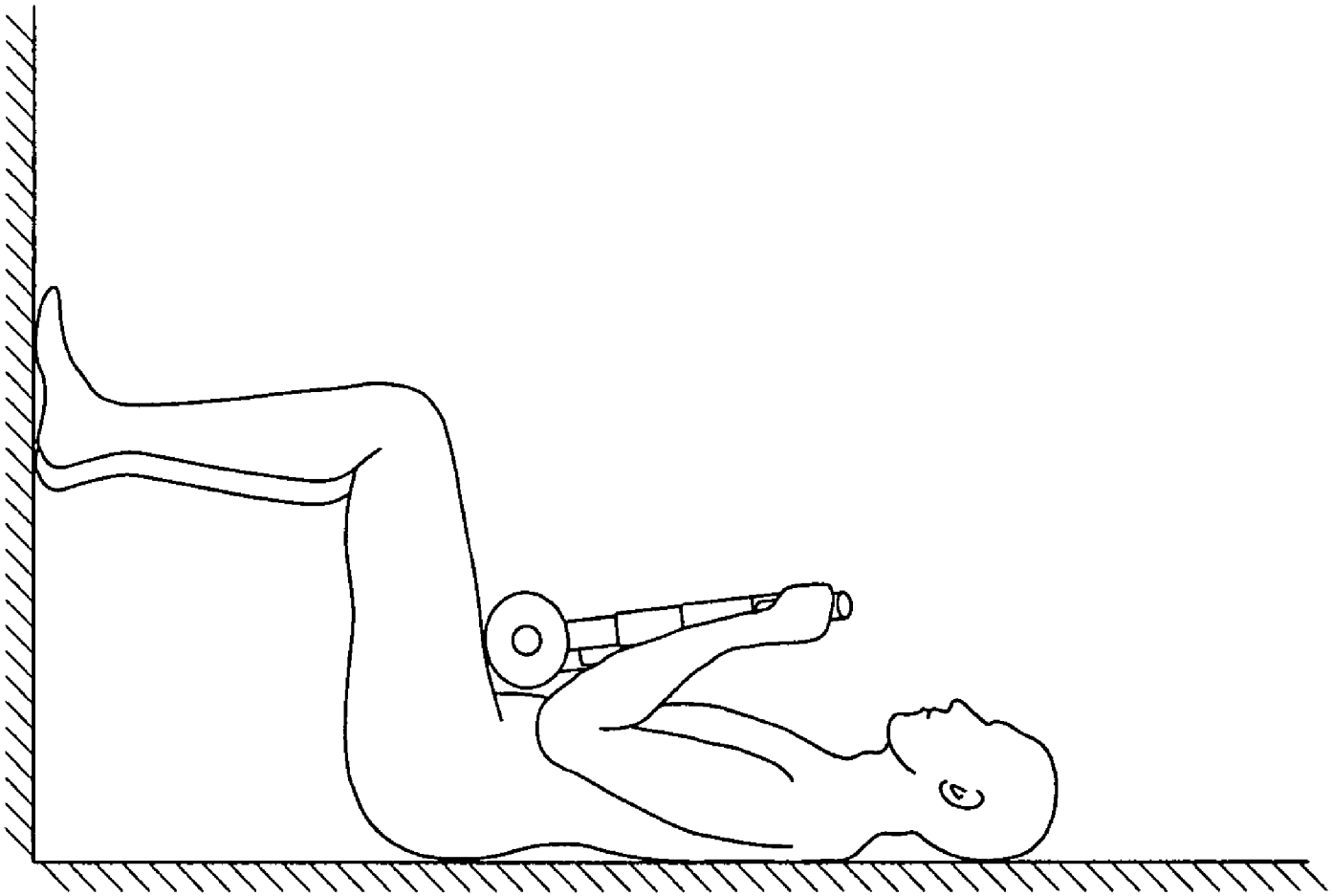
FIG. 21 depicts a side view demonstrating a user in a supine position lying on their back with their feet against a wall exercising with the isometric/pacing exercise device as incorporated with a compact abdominal exercise apparatus.

FIGS. 20A–20B depict a side view demonstrating a user in a sitting position exercising with the compact abdominal exercise apparatus 100. In FIG. 20A, a user is depicted in an upright seated position with the lower body support 102, 402, and 502 in contact with the tops of the users thighs and the users hands are grasping the handles 108, 408, and 508. In FIG. 20B, the user is in the crunched position. In FIG. 21, a user is depicted in a supine position with their back flat against the floor and their feet against a wall. The lower body support 102, 402, and 502 is in contact with the thighs and the users hands are grasping the handles 108, 408, and 508.

The compact abdominal exercise apparatus 100, 400, and 500 is ergonomically designed to be comfortable to a user. The handles 108, 408, and 508 are angled to facilitate a comfortable grasp of the user during use of the compact abdominal exercise apparatus 100, 400, and 500. Further the handle covers 146 and lower body support pad 106, 406, and 506 are composed of foam, or alternatively other soft materials such as plastic, rubber or Styrofoam. In addition, the lower body support 102, 402, and 502 is wide enough to be supported by two thighs of a user. Preferably, the width of the lower body support 102, 402, and 502 is between 8 and 20 inches. Most preferably, the width of the lower body support 102, 402, and 502 is 13 inches. The span of the handles 108, 408, and 508 are preferably between 5 and 30 inches, and most preferably 14 inches. Preferably, the height of the lower body support 102, 402, and 502 is between 1 and 14 inches, and most preferably 6 inches. Preferably, the height of the upper body support 104, 404, and 504 is between 2 and 12 inches, and most preferably 8 inches. The upper body support 104, 404, and 504, lower body support 102, 402, and 502, first member 112, 412, and 512, and second member 114, 414, 514 are composed of plastic, or alternatively other rigid lightweight materials such as plexiglass, polymeric materials, wood, aluminum and carbon.

In the preferred embodiment, the protective cover 116 is hingable and rotates about protective cover hinge tabs 176. In another embodiment, the protective cover 116 preferably contains access holes or portions to enable a user to change the elastic members 130, 132, and 160 without rotating the protective cover 116. The protective cover 116 is made of the same of different material than the first member 112 and second member 114 as described above.

The first member proximal end 118 is the same end that the handles 108 are attached to the first member 112. The first member distal end 120 is the opposite end from the first member proximal end 118 of the first member 112. The second member proximal end 122 is the same end that the lower body support 102 is attached to the second member 114. The second member distal end 124 is the opposite end from the second member proximal end 122 of the second member 114.

In the preferred embodiment, the first elastic member anchor 126 and second elastic member anchor 128 preferably holds one, two or more elastic members 130, 132, and 160. The first elastic member anchor 126 is located in the proximity of the first member distal end 120. The second elastic member anchor 128 is located in the proximity of the second member distal end 124. As a user increases the compressive force on the first member 112 towards the second member 114 during exercise, the distance between the first elastic member anchor 126 and the second elastic member anchor 128 increases, thereby increasing the tensile stress on the elastic members 130, 132, and 160. Conversely, as a user decreases the compressive force on the first member 112 towards the second member 114, the distance between the first elastic member anchor 126 and the second elastic member anchor 128 decreases, thereby decreasing the tensile stress on the elastic members 130, 132, and 160.

The upper body support and lower body support connector assembly 110 can be configured in a variety of embodiments. The connector assembly 110 includes the first member 112 and the second member 114, whereby the first member 112 and the second member 114 slide past each other relatively to enable a compressive type movement. In one embodiment and as would be known to those skilled in the art, the first member 112 is attached to the upper body support 104 and the second member 114 is attached to the lower body support 102. In another embodiment, the first member 112 preferably is attached to the lower body support 102 and the second member 114 preferably is attached to the upper body support 104.

The compact abdominal exercise apparatus 100, 400, and 500 preferably includes one, two or more elastic members. In the preferred embodiment, the compact abdominal exercise apparatus 100, 400, and 500 includes a first elastic member 130 and a second elastic member 132. In another embodiment of the present invention, there preferably is a third elastic member 160. The elastic members 130, 132, and 160 are rubber tubing or other material capable of creating a resistive force upon stretching. Alternatively, other elastic members could be other resistive forces, such as hook and ring ends for springs, compressed gas pistons, an air bag compressed by a plunger, compressed or extended coil springs, stretching a band that is mounted sideways with a hook or roller, compressing a foam or elastomer spring or donut, a torsion spring like a tape measure, flat elastic band style spring, a scissor arrangement, and handles attached to an air bag.

In the preferred embodiment, the elastic members 130, 132, and 160 have an elastic member end 178 at one or both ends of the elastic members 130, 132, and 160. The elastic member end 178 allows a user to quickly connect and disconnect the elastic members 130, 132, and 160 from the first elastic member anchor member 126 and second elastic member anchor member 128. The elastic member end 178 of the elastic members 130, 132, and 160 preferably are of a large diameter or size to facilitate connection to the first elastic member anchor member 126 and second elastic member anchor member 128. The elastic member body 190 preferably is of a size that is smaller than the elastic member end 178 to slide through the first elastic anchor member holes 192.

The first elastic anchor member holes 192 in the first elastic member anchor member 126 and second elastic member anchor member 128, preferably are one, two or more. In one embodiment, there are two first elastic anchor member holes 192 in the first elastic member anchor member 126 and second elastic member anchor member 128 and in another embodiment of the present invention, there three first elastic anchor member holes 192 in the first elastic member anchor member 126 and second elastic member anchor member 128. The optional spare elastic member ribs 134 hold additional elastic members that are not in use, as shown in FIG. 3. Alternatively, the first elastic anchor member 126 and second elastic anchor member 128 preferably comprise a hook type of arrangement, such that it accepts elastic members that are capable of being attached to this hook type of arrangement.

As described above, the compact abdominal exercise apparatus 100, 400, and 500 preferably comprises a variety of molded pieces that are assembled into one unit. The molded pieces preferably are fastened together using screws and screw bosses 136, or alternatively other fasteners. These fasteners preferably are located in a variety of locations and are not limited by those shown in FIG. 6 or other figures.

The compact abdominal exercise apparatus 100 includes slot 138. In the preferred embodiment, slot 138 is formed in the center of the back first member 158. Slot 138 allows the first member 112 to slide between the first elastic anchor member 126 that is fastened to the second member 114 by elastic anchor member fasteners 140. Preferably, the length of slot 138 is between 1 and 16 inches, and most preferably 6 inches. Preferably, the width of slot 138 is between 0.1 and 2.0 inches, and most preferably 0.25 inches.

The elastic anchor member fasteners 140 preferably are bolts or other fasteners. In the preferred embodiment, the elastic anchor member fasteners 140 preferably are of a width less than the slot 138, to enable the second member 114 to attach to the first elastic anchor member 126. The vent holes 142 allow pressure equalization within the housing of the compact abdominal exercise apparatus 100. In the preferred embodiment, the vent holes 142 are located preferably near the second member proximal end 122, and can be located elsewhere to facilitate pressure equalization.

In the preferred embodiment of the present invention, the first member 112 slides within the second member 114, via second member outer channels 144 and second member inner channels 150. In the preferred embodiment, the first member 112 is attached to the upper body support 104 and the second member 114 is attached to the lower body support 102. As described above and as would be known to those skilled in the art, this configuration could be swapped, whereby the first member 112 is attached to the lower body support 102 and the second member 114 is attached to the upper body support 104.

The second member outer channels 144 and second member inner channels 150 define the second member channels 135, as shown in FIG. 6. The first member channels 137 slide within the second member channels 135. The second elastic anchor member mounts 148 accepts the elastic anchor member fasteners 140.

The slotted protective access cover 466 includes a quick access opening 468 that allows a user to access and quickly connect or disconnect the elastic members 430, 432, and 460, thereby increasing or decreasing the resistive force of the compact abdominal exercise apparatus 400. In this embodiment, the elastic members 430, 432 and 460 preferably are connected or disconnected from either the first elastic anchor member 426 or the second elastic anchor member 428 without opening a cover, while also providing protection for the user from the internal connector assembly 110. In the embodiment 400 depicted in FIG. 18 the upper rear protective cover 470 and upper front protective cover 472 also protect the user from the internal connector assembly 110. The upper rear protective cover 470 and upper front protective cover 472 are attached together by fasteners as described above or preferably they snap around the first member 412. The lower front protective cover 474 and lower back protective cover 475 preferably attach to each other by fasteners as described above or they preferably snap around the second member 414. Preferably, covers 470, 472, 474, and 475 are made of plastic, or alternatively some other lightweight material.

In the preferred embodiment, the protective cover 116 includes the protective cover hinge tabs 176 that slide into the front second member holes 188, thereby creating a hingable cover for opening to access the connector assembly 110 and the elastic members 130, 132, and 160. The protective cover hinge tabs 176 protrude slightly from the sides of the protective cover 116 to fit into the front second member holes 188. Other methods of opening and closing the protective cover 116 such as clips and snaps, or other methods commonly known to those skilled in the art, can be employed.

The second elastic anchor member 128 includes a second elastic anchor member upper catch 182 that is sized smaller than the elastic member end 178 of the elastic members 130, 132, and 160. The second elastic anchor member opening 180 is sized slightly larger in diameter than the elastic member body 190 of the elastic members 130, 132, and 160. The second elastic anchor member indent 184 fits the first member ridge 139 and the second elastic anchor member curved portion 183 fits the first member channels 137.

The first member 112 includes a first member ridge 139 at the junction of the first member channels 137. In FIG. 6 one first member ridge 139 is depicted, however, the compact abdominal exercise apparatus 100 preferably includes one, two or more first member ridges 139. The first member channels 137 have a slightly smaller diameter than the second member channels 135, to allow for the first member 112 to slideably move within the second member 114.

The compact abdominal exercise apparatus 100 includes a first isometric/pacing element 195, such as a clicker or other aural or visual producing device to notify a user that the compact abdominal exercise apparatus 100 is at a certain position. The clicker tab 197 contacts the tab 151 to produce a sound thereby notifying the user that they have reached a certain position during the crunching exercise. As the first member 112 is forced towards the second member 114, the first isometric/pacing element 195 moves with the first member 112 downward towards the tab 151 and produces a clicking sound once it contacts the tab 151. Preferably, the sound notifies the user to stop at that position thereby exercising the muscle against constant resistance. The compact abdominal exercise apparatus preferably includes one, two or more tabs 151, to produce a multi-stop exercise apparatus.

In another embodiment of the present invention, the first isometric/pacing element 82 includes a radar transmit/receive antenna to determine the position of the exercise apparatus relative to a second isometric/pacing element 84, such as a floor, wall, ceiling, cross-member, cross-member, or frame member. In this embodiment, the first isometric/pacing element 82 is capable of producing an aural or visual signal for a predetermined position of an exercise motion, to alert the user to hold the exercise position. The first isometric/pacing element 82 measures the distance that it has traveled relative to the second isometric/pacing element 84 by transmitting a frequency-modulated continuous radio frequency signal via an antenna onto a second isometric/pacing element 84. Echo signals from the second isometric/pacing element 84 are received by the transmit/receive antenna and a distance determination is made by the first isometric/pacing element 82. If the distance traveled by the first isometric/pacing element 82 is equal to a user preselected distance, then an aural or visual signal is produced to alert the user to hold the position. The distance traveled can be relative to the fully extended or resting position or both.

The isometric/pacing exercise device 50 predetermined positions can be those between a fully extended position and a fully resting position of most exercise apparatuses. A fully extended position of an exercise apparatus is that position which a user, through muscular exertion, extends the exercise apparatus to its designed stops, whereby no further movement in that direction is achievable. A fully resting position of an exercise apparatus is that position where no muscular exertion is applied to the exercise apparatus. Predetermined positions of the isometric/pacing exercise device 50 are those along the exercise motion that a user desires to be alerted, so that they may hold the position and receive the benefits of isometric exercise. These predetermined positions may be between the fully extended and resting positions, or may include one or both of the fully extended and resting positions.

The compact abdominal exercise apparatus 100, 400, and 500 can be used in a seated position, as in FIGS. 20A–20B, or a supine position with legs bent, as in FIG. 21. In the seated position, as depicted in FIGS. 20A–20B, the user rests the lower body support 102, 402, and 502 on the top of the legs in the lap area, grasps the handles 108, 408, and 508 and then crunches downward applying pressure on the handles 108, 408, and 508 such that the first member 112, 412, and 512 slides down within the connector assembly 110 causing the first elastic members 130, 132, 160, 430, 432, and 460 to stretch and provide a resistive force against the downward crunching movement.

In the preferred embodiment, at a certain position of the downward crunching movement, the first isometric/pacing element 52, 62, 72, 82, and 195 produces a sound that notifies the user to pause the downward motion for a period of time, such as six seconds or so, and then continue the downward motion until the first isometric/pacing element 52, 62, 72, 82, and 195 produces another sound as it contacts the second isometric/pacing element 54, 74, and 84. At this point the user preferably pauses again to exercise the muscles against a constant resistance for a period of time, such as six seconds or so, and then continue the downward motion until the first isometric/pacing element 52, 62, 72, 82, and 195 produces another sound and user preferably pauses again. The clicker preferably also sounds on the upward motion, and the user may pause at these times also. Though the isometric/pacing exercise device in the preferred embodiment is a clicker, a musical tone, a light, or any other announcer may be used. In another embodiment, the isometric/pacing exercise device is a radar range device which produces an aural or visual signal to the user when predetermined positions are reached by the exercise apparatus.

In the preferred embodiment, the compact abdominal exercise apparatus 100, 400, and 500 requires the user to crunch relatively straight downward in order for the first member 112, 412, and 512 to slide within the connector assembly as shown in FIGS. 20A–20B. This relatively straight downward crunching motion requires flexion of the user's lower vertebra column thereby isolating the abdominal muscles as opposed to an incorrect crunch involving bending the body forward at the hips which recruits the hip flexors (seated or supine positions) and/or lower back muscles (seated position). The upper body support 104, 404, and 504 is designed to provide for maximum sliding motion between the first member 112, 412, and 512 and the second member 114, 414, and 514 while maintaining a compact design that rests comfortably on the user's lap and the handles 108, 408, and 508 are approximately at chest height.

The aforementioned crunching motion provides resistive training of all of the abdominal muscles, including the upper and lower rectus abdominis, the internal and external abdominal obliques and the transverse abdominis. In the preferred embodiment, the invention provides for one or more resistance levels such that the user can add additional elastic members 130, 132, and 160 for higher resistance as their firmness level increases. Further, the beginner resistance level is approximately 10 pounds resistive force and progresses up to more than 50 pounds of resistive force for advance settings using additional elastic members 130, 132, and 160.

The compact abdominal exercise apparatus 100, 400, and 500 can alternatively be used in the supine position, as depicted in FIG. 21. In the supine position, the user lies flat on his/her back with legs bent with feet either flat on the floor or with feet against a wall or other stable surface. The crunching movement is similar to that described for the seated crunch, however, in the supine position, the user must also overcome the gravitational resistance of the user's upper body in addition to the resistive force of the compact abdominal exercise apparatus 100, 400, and 500 during the crunching motion. The resistive force provided by the present invention therefore enhances the supine crunch providing abdominal training beyond what is achievable from a standard supine crunch without the compact abdominal exercise apparatus.

Figure 22:
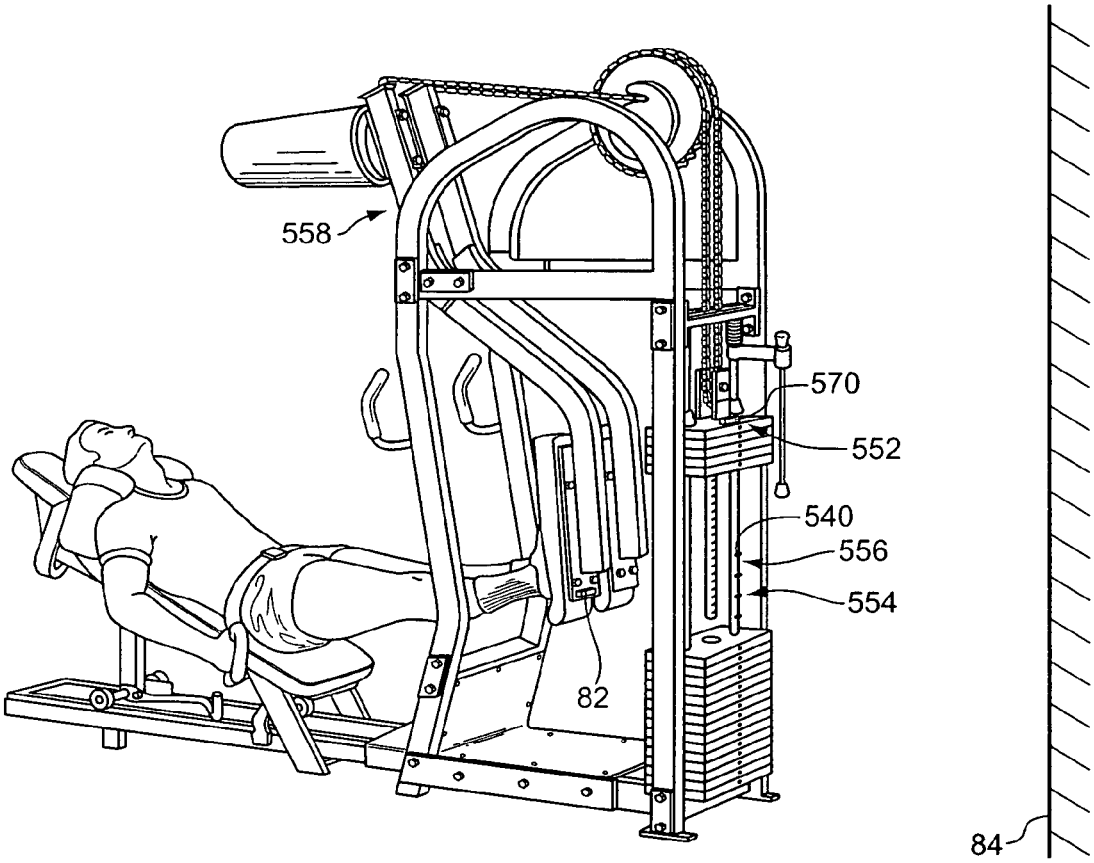
FIG. 22 depicts a perspective view demonstrating a user exercising with the isometric/pacing exercise device as incorporated with a compound weight lifting exercise machine.

The isometric contraction exercise device 50 can alternatively be used in a variety of exercise apparatuses. FIG. 22 depicts a compound weight lifting exercising machine incorporating the isometric contraction exercise device. In this embodiment, the first isometric/pacing element 570 can be attached to the top of weight stack 552 and the second isometric/pacing element 540 can be attached to the weight guide poles 554. In this embodiment the first isometric/pacing element 570 comes in contact with one of the plurality of tabs 556 of the second isometric/pacing element 540 and produces a signal. The first isometric/pacing element 570 and the second isometric/pacing element 540 can be located in other positions of the compound weight lifting exercising machine, such as in location 558 or other locations that will enable an audio or visual signal to be produced. In another embodiment of the present invention, the first isometric element 82 can be adapted to a moving part of the compound weight lifting exercising machine and pointed toward a second isometric/pacing element 84 such as the floor, wall, ceiling, cross-member, or frame member. The first isometric member 82 sends a frequency-modulated continuous radio frequency signal toward the second isometric/pacing element 84 which then bounces back to the first isometric member 82. A distance determination of the first isometric member 82 relative to the second isometric/pacing element 84 is made to determine whether a predetermined distance has been reached, if it has a signal, either aural or visual, is produced to alert the user to hold the exercise position.

Figure 23:
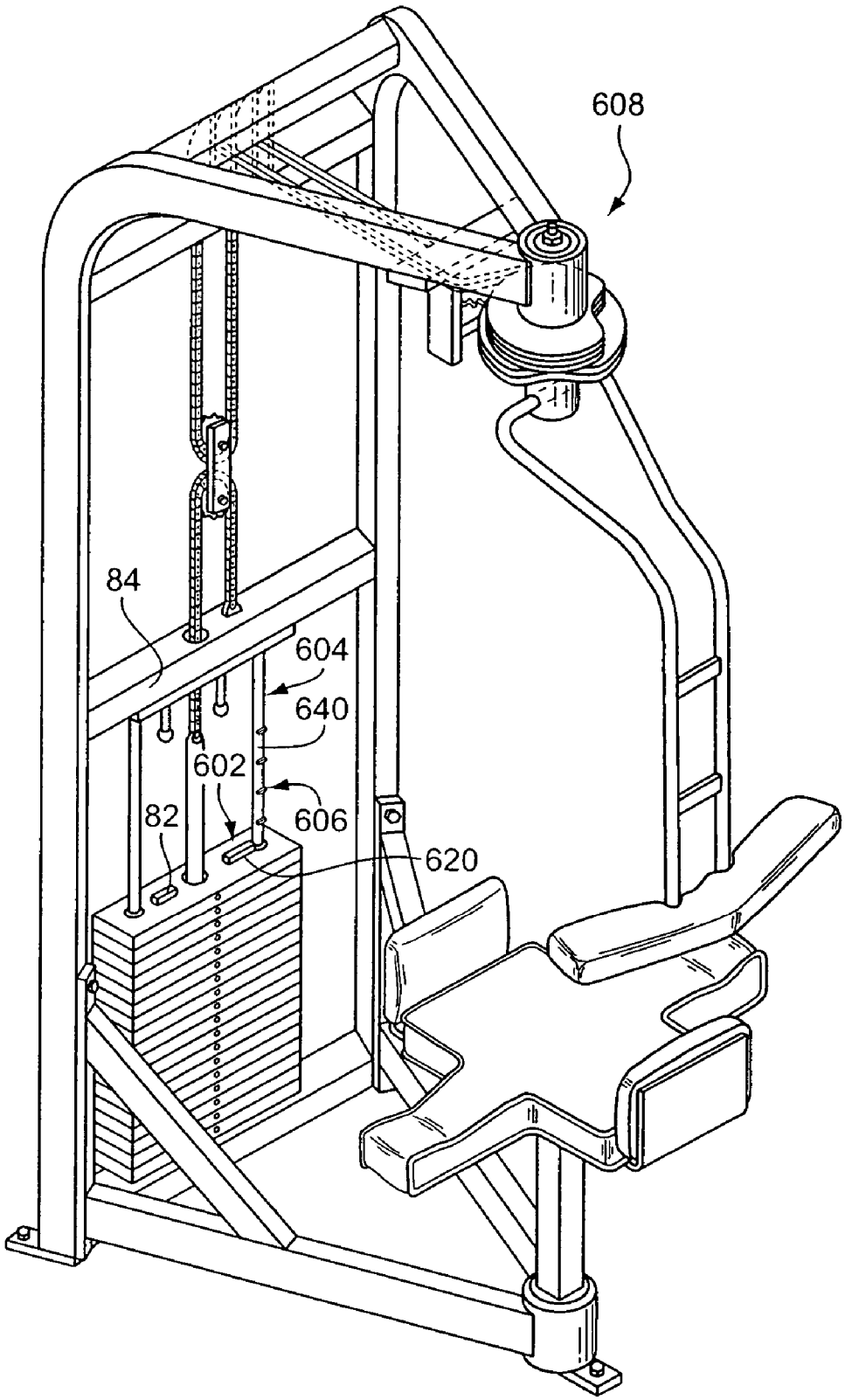
FIG. 23 depicts a perspective view demonstrating an isometric/pacing exercise device as incorporated with a rotary torso exercise apparatus.

In another embodiment, FIG. 23 depicts a rotary torso exercise apparatus incorporating the isometric contraction exercise device. In this embodiment, the first isometric/pacing element 620 can be attached to the top of weight stack 602 and the second isometric/pacing element 640 can be attached to the weight guide poles 604. In this embodiment the first isometric/pacing element 620 comes in contact with one of the plurality of tabs 606 of the second isometric/pacing element 640 and produces a signal. The first isometric/pacing element 620 and the second isometric/pacing element 640 can be located in other positions of the rotary torso exercise apparatus, such as in location 608 or other locations that will enable a audio or visual signal to be produced. In another embodiment of the present invention, the first isometric member 82 can be adapted to a moving part of the rotary torso exercise apparatus and pointed toward a second isometric/pacing element 84 such as the floor, wall, ceiling, cross-member, or frame member. The first isometric member 82 sends a frequency-modulated continuous radio frequency signal toward the second isometric/pacing element 84 which then bounces back to the first isometric member 82. A distance determination of the first isometric member 82 relative to the second isometric/pacing element 84 is made to determine whether a predetermined distance has been reached, if it has a signal, either aural or visual, is produced to alert the user to hold the exercise position.

Figure 24:
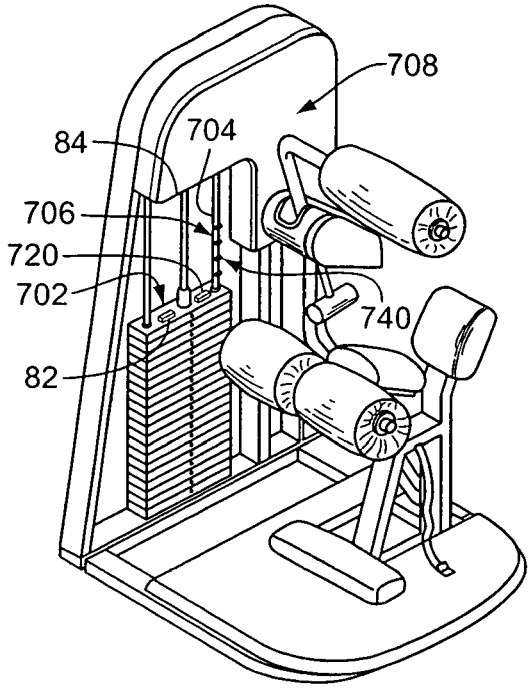
FIG. 24 depicts a perspective view demonstrating an isometric/pacing exercise device as incorporated with a weight lifting lower back exercising machine.

Also, FIG. 24 depicts a weight lifting lower back exercising machine incorporating the isometric contraction exercise device. In this embodiment, the first isometric/pacing element 720 can be attached to the top of weight stack 702 and the second isometric/pacing element 740 can be attached to the weight guide poles 704. In this embodiment the first isometric/pacing element 720 comes in contact with one of the plurality of tabs 706 of the second isometric/pacing element 740 and produces a signal. The first isometric/pacing element 720 and the second isometric/pacing element 740 can be located in other positions of the weight lifting lower back exercising machine, such as in location 708 or other locations that will enable an audio or visual signal to be produced. In another embodiment of the present invention, the first isometric member 82 can be adapted to a moving part of the weight lifting lower back exercising machine and pointed toward a second isometric/pacing element 84 such as the floor, wall, ceiling, cross-member, or frame member. The first isometric member 82 sends a frequency-modulated continuous radio frequency signal toward the second isometric/pacing element 84 which then bounces back to the first isometric member 82. A distance determination of the first isometric member 82 relative to the second isometric/pacing element 84 is made to determine whether a predetermined distance has been reached, if it has a signal, either aural or visual, is produced to alert the user to hold the exercise position.

Figure 25:
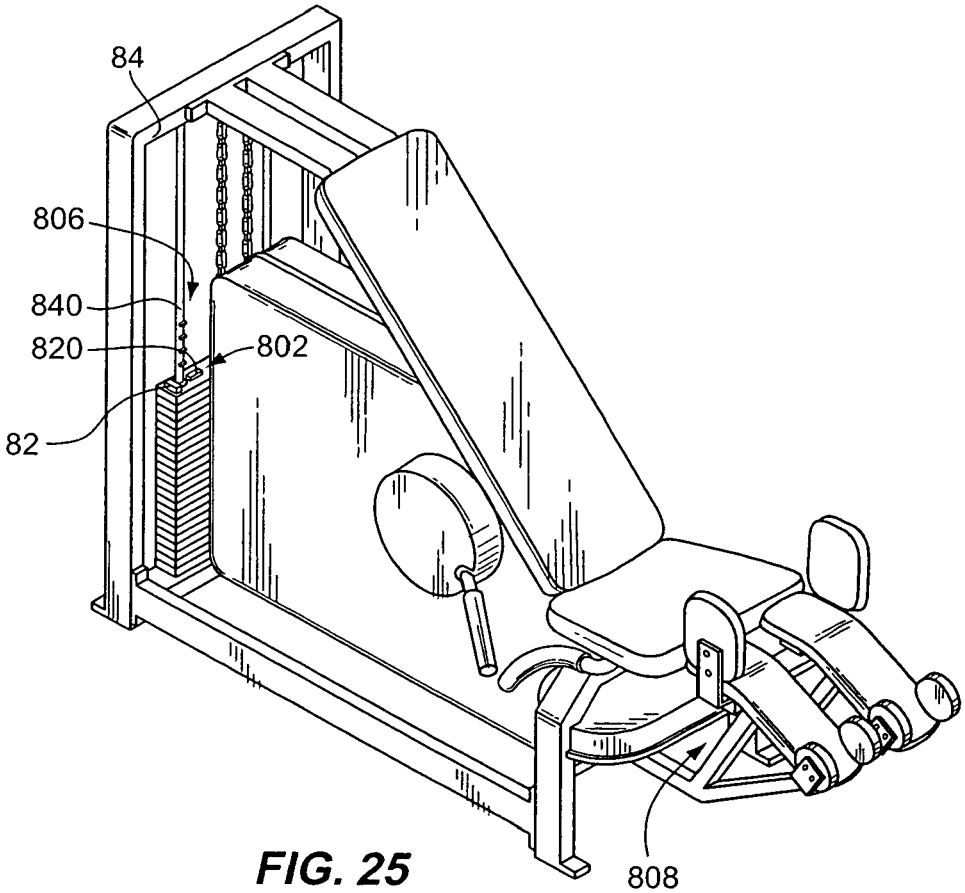
FIG. 25 depicts a perspective view demonstrating an isometric/pacing exercise device as incorporated with a abductor or adductor exercising apparatus.

In addition, FIG. 25 depicts an abductor and adductor exercising apparatus incorporating the isometric contraction exercise device. In this embodiment, the first isometric/pacing element 820 can be attached to the top of weight stack 802 and the second isometric/pacing member 840 can be attached to the weight guide poles 804. In this embodiment the first isometric/pacing element 820 comes in contact with one of the plurality of tabs 806 of the second isometric/pacing element 840 and produces a signal. The first isometric/pacing element 820 and the second isometric/pacing element 840 can be located in other positions of the weight lifting lower back exercising machine, such as in location 808 or other locations that will enable a audio or visual signal to be produced. In another embodiment of the present invention, the first isometric member 82 can be adapted to a moving part of the abductor and adductor exercising apparatus and pointed toward a second isometric/pacing element 84 such as the floor, wall, ceiling, cross-member, or frame member. The first isometric member 82 sends a frequency-modulated continuous radio frequency signal toward the second isometric/pacing element 84 which then bounces back to the first isometric member 82. A distance determination of the first isometric member 82 relative to the second isometric/pacing element 84 is made to determine whether a predetermined distance has been reached, if it has a signal, either aural or visual, is produced to alert the user to hold the exercise position.

Figure 26:
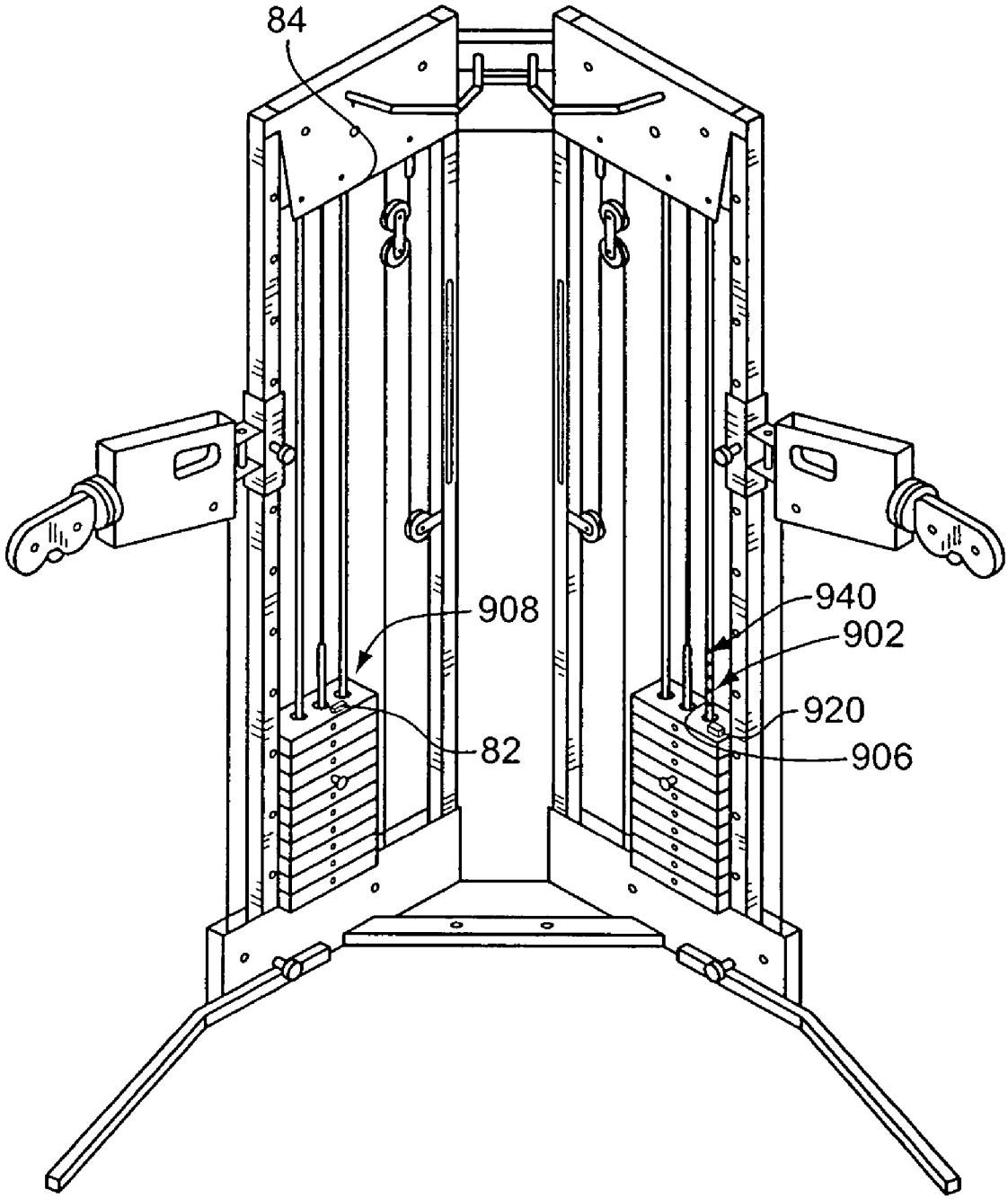
FIG. 26 depicts a perspective view demonstrating an isometric/pacing exercise device as incorporated with an exercise machine.

Also, FIG. 26 depicts an exercise machine incorporating the isometric contraction exercise device. In this embodiment, the first isometric/pacing element 920 can be attached to the top of weight stack 902 and the second isometric/pacing element 940 can be attached to the weight guide poles 904. In this embodiment the first isometric/pacing element 920 comes in contact with one of the plurality of tabs 906 of the second isometric/pacing element 940 and produces a signal. The first isometric/pacing element 920 and the second isometric/pacing element 940 can be located in other positions of the weight lifting lower back exercising machine, such as in location 908 or other locations that will enable a audio or visual signal to be produced. In another embodiment of the present invention, the first isometric member 82 can be adapted to a moving part of the exercise machine and pointed toward a second isometric/pacing element 84 such as the floor, wall, ceiling, cross-member or frame member. The first isometric member 82 sends a frequency-modulated continuous radio frequency signal toward the second isometric/pacing element 84 which then bounces back to the first isometric member 82. A distance determination of the first isometric member 82 relative to the second isometric/pacing element 84 is made to determine whether a predetermined distance has been reached, if it has a signal, either aural or visual, is produced to alert the user to hold the exercise position.

In another aspect of the present invention, the first isometric/pacing elements 52, 62, 72, and 82 and the second isometric/pacing elements 54, 64, 74, and 84 produce an aural or visual signal when they come in proximity of each other. In this aspect, first isometric/pacing elements 52, 62, and 72 comprise a material that is sensed by the second isometric/pacing elements 54, 64, and 74 when they come in proximity of each other, thereby signaling the user to pause the exercise and isometrically exert force against that provided by the exercise apparatus. This signal can be visual or aural. The sensing and signaling aspects of this invention are corresponding electrical circuits commonly known.

In another aspect of the above mentioned embodiments, the first isometric/pacing elements 52, 62, 72, and 82 and the second isometric/pacing elements 54, 64, 74, and 84 can be located relative to the exercise apparatus where the exercise apparatus produces a linear, curvilinear, or patterned motion between elements of the exercise apparatus. For example, the first isometric/pacing elements 52, 62, 72, and 82 can be adapted to the movement arm of the exercise apparatus, while the second isometric/pacing elements 54, 64, 74, and 84 can be adapted to be in the movement path of the movement arm. In yet another aspect of the above mentioned embodiments, the first isometric/pacing element 82 can be located relative to the exercise apparatus where the exercise apparatus produces a linear, curvilinear, or patterned motion between the elements of the exercise apparatus.

Many different exercise apparatuses can be adapted to an isometric exercising apparatus by a user. For example, the isometric contraction exercise device could be adapted to a bicep curling machine, lat pull down machine, and leg squat machine. The isometric contraction exercise device can be adapted to exercise equipment that has either a weight stack or method which guides the travel of the exercise movement. The first isometric/pacing elements 52, 62, 72, and 82 can be attached to either a weight stack that slides up and down, or can be attached to the movement arm of the exercise device, or any other location where the exercise device undergoes either a linear, circular or patterned movement.

Many different exercises can be performed by a user exercising with the isometric contraction exercise device adapted to an existing exercise apparatus. For example, the user can hold an isometric contraction each time the isometric contraction exercise device signals the user to hold the position. The user can choose how long to hold the position and can vary the holding time for each signaled stop independent of the isometric contraction exercise device.

In another example, a user can use the isometric contraction exercise device as a cadence to pace themselves through the exercise. So if a user wants to perform a controlled repetition, concentric phase and eccentric phase, the user can use the signals provided by the isometric contraction exercise device to pace the repetition. With the isometric contraction exercise device, a user could use the signal to pace the exercise, similar to a cadence. This way a user can pace themselves by using the signal emitted from the isometric contraction exercise device to modulate the concentric and eccentric phase of the exercise, and thereby receive a better and more effective workout. This modulation decreases the momentum caused by a faster exercise movement, and thereby provides for more adequate muscle activation. Alternately, a user can combine any number of up or down signals as desired to provide themselves with a proper pace or modulation. Similarly, a user can accent either the concentric phase or the eccentric phase, of the exercise, by modulating one phase instead of both phases. The present invention provides this control of pacing movement.

In another example, the isometric contraction exercise device can provide a user with a signal that represents a "power range" that is of importance to the user. The isometric contraction exercise device allows a user then to focus their exercise regiment on these power ranges to gain more strength where their muscles may be weaker in a specific range of motion, or for sports specific training where the sport demands more strength in a specific range. So for instance, many weight lifters desire to emphasize the top third movement in a bicep curl. In this position point emphasis, a user would just focus the exercise between the top third of the bicep motion, and would perform several repetitions between these signals provided for by the isometric contraction exercise device.

In a further example, a user may combine the above stated methods, so that a user performs a full range of motion repetition and then performs two or more power range, or emphasis movements, at the top of the concentric phase of the exercise. Followed by a downward release.

In yet another example, a user can cycle through the above methods in their training routine as a way to "shock" the muscles for ongoing strength improvements. Typical exercise practice is to change the exercise routine every few weeks because the muscles become use to a particular exercise routine and motion. The present invention provides the user with a powerful exercise tool to perform a variety of methods to modify their routine and effectively strengthen their muscles.

There has been described an isometric contraction exercise device that signals or alerts the user to pause and isometrically exert force against the resistive force of the exercising apparatus. It should be understood that the particular embodiments shown in the drawings and described within this specification are for purposes of example and should not be construed to limit the invention, which will be described in the claims below. Further, it is evident that those skilled in the art may now make numerous uses and modifications of the specific embodiments described, without departing from the inventive concepts. Consequently, the invention is to be construed as embracing each and every novel feature and novel combination of features present in and/or possessed by the invention herein described.

The invention claimed is:

1. A method of operating an exercise apparatus, said method comprising:

moving a portion of said exercise apparatus;

providing a signal when said portion has moved a predetermined distance;

pausing said movement at said signal; and continuing said movement after a time period.

2. A method as in claim 1 wherein said providing comprises:

transmitting a radar signal; and receiving a reflected radar signal.

3. A method as in claim 1 wherein said moving comprises moving a first isometric member and said providing comprises interacting said first isometric member with a second isometric member.

4. A method of operating an exercise apparatus, said method comprising:

moving a portion of said exercise apparatus;

providing a signal when said portion has moved a predetermined distance; and pacing said movement with said signal.

5. A method of operating an exercise apparatus as in claim 1 wherein said providing a signal comprises providing an aural signal.

6. A method of operating an exercise apparatus as in claim 1 wherein said providing a signal comprises providing a visual signal.

7. A method of operating an exercise apparatus as in claim 4 wherein said providing a signal comprises providing an aural signal.

8. A method of operating an exercise apparatus as in claim 4 wherein said providing a signal comprises providing a visual signal.

* * * * *